US010689737B2

(12) United States Patent
Wakita et al.

(10) Patent No.: US 10,689,737 B2
(45) Date of Patent: Jun. 23, 2020

(54) HOT-ROLLED STEEL SHEET

(71) Applicant: NIPPON STEEL & SUMITOMO METAL CORPORATION, Tokyo (JP)

(72) Inventors: Masayuki Wakita, Tokyo (JP); Mitsuru Yoshida, Tokyo (JP); Natsuko Sugiura, Tokyo (JP); Hiroshi Shuto, Tokyo (JP); Tatsuo Yokoi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 173 days.

(21) Appl. No.: 15/549,093

(22) PCT Filed: Feb. 25, 2015

(86) PCT No.: PCT/JP2015/055455
§ 371 (c)(1),
(2) Date: Aug. 4, 2017

(87) PCT Pub. No.: WO2016/135896
PCT Pub. Date: Sep. 1, 2016

(65) Prior Publication Data

US 2018/0037980 A1 Feb. 8, 2018

(51) Int. Cl.

| | |
|---|---|
| ***C21D 9/46*** | (2006.01) |
| ***C22C 38/58*** | (2006.01) |
| ***C22C 38/26*** | (2006.01) |
| ***C22C 38/24*** | (2006.01) |
| ***C22C 38/32*** | (2006.01) |
| ***C22C 38/38*** | (2006.01) |
| ***C22C 38/28*** | (2006.01) |
| ***C22C 38/22*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C23C 2/02*** | (2006.01) |
| *B21B 1/22* | (2006.01) |

(52) U.S. Cl.
CPC ..... *C22C 38/58* (2013.01); *C21D 8/0205* (2013.01); *C21D 8/0226* (2013.01); *C21D 8/0263* (2013.01); *C21D 9/46* (2013.01); *C22C 38/001* (2013.01); *C22C 38/02* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C23C 2/02* (2013.01); *B21B 2001/228* (2013.01)

(58) Field of Classification Search
CPC ..... C22C 38/00; C23C 2/02
USPC ..... 148/335
See application file for complete search history.

(56) References Cited

U.S. PATENT DOCUMENTS

| | | | |
|---|---|---|---|
| 4,501,626 | A | 2/1985 | Sudo et al. |
| 6,251,198 | B1 | 6/2001 | Koo et al. |
| 6,254,698 | B1 | 7/2001 | Koo et al. |
| 6,589,369 | B2 | 7/2003 | Yokoi et al. |
| 7,662,243 | B2 | 2/2010 | Yokoi et al. |
| 7,749,338 | B2 | 7/2010 | Yokoi et al. |
| 8,353,992 | B2 | 1/2013 | Sugiura et al. |
| 2002/0036035 | A1 | 3/2002 | Kashima et al. |
| 2003/0063996 | A1 | 4/2003 | Funakawa et al. |
| 2004/0074573 | A1 | 4/2004 | Funakawa et al. |
| 2005/0150580 | A1 | 7/2005 | Akamizu et al. |
| 2006/0081312 | A1 | 4/2006 | Yokoi et al. |
| 2006/0266445 | A1 | 11/2006 | Yokoi et al. |
| 2009/0050243 | A1 | 2/2009 | Satou et al. |
| 2009/0050244 | A1 | 2/2009 | Nakagawa et al. |
| 2009/0092514 | A1 | 4/2009 | Asahi et al. |
| 2010/0047617 | A1 | 2/2010 | Sugiura et al. |
| 2010/0108200 | A1 | 5/2010 | Futamura et al. |
| 2010/0108201 | A1 | 5/2010 | Yokoi et al. |

(Continued)

FOREIGN PATENT DOCUMENTS

| | | | |
|---|---|---|---|
| CA | 2882333 | A1 | 4/2014 |
| CA | 2944863 | A1 | 10/2015 |

(Continued)

OTHER PUBLICATIONS

Extended European Search Report, dated Sep. 12, 2018, for corresponding European Application No. 15883192.5.

(Continued)

*Primary Examiner* — Jie Yang

(74) *Attorney, Agent, or Firm* — Birch, Stewart, Kolasch & Birch, LLP

(57) ABSTRACT

A hot-rolled steel sheet includes a chemical composition represented by, in mass %, C: 0.010% to 0.100%, Si: 0.30% or less, Cr: 0.05% to 1.00%, Nb: 0.003% to 0.050%, Ti: 0.003% to 0.200% and others, wherein a proportion of grains having an intragranular misorientation of 5° to 14° in all grains is 20% or more by area ratio, the grain being defined as an area which is surrounded by a boundary having a misorientation of 15° or more and has a circle-equivalent diameter of 0.3 μm or more.

5 Claims, No Drawings

(56) References Cited

U.S. PATENT DOCUMENTS

| | | | | |
|---|---|---|---|---|
| 2010/0319819 | A1 | 12/2010 | Kaneko et al. | |
| 2011/0017360 | A1 | 1/2011 | Yoshinaga et al. | |
| 2011/0024004 | A1 | 2/2011 | Azuma et al. | |
| 2011/0297281 | A1 | 12/2011 | Satou et al. | |
| 2012/0012231 | A1 | 1/2012 | Murakami et al. | |
| 2012/0018028 | A1 | 1/2012 | Shimamura et al. | |
| 2012/0031528 | A1 | 2/2012 | Hayashi et al. | |
| 2013/0000791 | A1 | 1/2013 | Takahashi et al. | |
| 2013/0087254 | A1 | 4/2013 | Funakawa et al. | |
| 2013/0276940 | A1 | 10/2013 | Nakajima et al. | |
| 2013/0319582 | A1 | 12/2013 | Yokoi et al. | |
| 2014/0000765 | A1 | 1/2014 | Nozaki et al. | |
| 2014/0014236 | A1 | 1/2014 | Nozaki et al. | |
| 2014/0014237 | A1 | 1/2014 | Yokoi et al. | |
| 2014/0027022 | A1 | 1/2014 | Yokoi et al. | |
| 2014/0087208 | A1 | 3/2014 | Toda et al. | |
| 2014/0110022 | A1* | 4/2014 | Sano | C21D 8/0236 148/504 |
| 2014/0255724 | A1 | 9/2014 | Yamanaka et al. | |
| 2014/0287263 | A1 | 9/2014 | Kawata et al. | |
| 2014/0290807 | A1 | 10/2014 | Goto et al. | |
| 2015/0004433 | A1 | 1/2015 | Tanaka et al. | |
| 2015/0030879 | A1 | 1/2015 | Kosaka et al. | |
| 2015/0071812 | A1 | 3/2015 | Kawano et al. | |
| 2015/0101717 | A1 | 4/2015 | Kosaka et al. | |
| 2015/0191807 | A1 | 7/2015 | Hanlon et al. | |
| 2015/0203949 | A1 | 7/2015 | Yokoi et al. | |
| 2015/0218708 | A1 | 8/2015 | Maruyama et al. | |
| 2016/0017465 | A1 | 1/2016 | Toda et al. | |
| 2018/0023162 | A1* | 1/2018 | Sugiura | C21D 9/46 420/83 |
| 2018/0037967 | A1 | 2/2018 | Sugiura et al. | |
| 2018/0037980 | A1 | 2/2018 | Wakita et al. | |
| 2018/0044749 | A1* | 2/2018 | Shuto | C22C 38/48 |
| 2019/0226061 | A1* | 7/2019 | Sano | C22C 38/00 |
| 2019/0233926 | A1* | 8/2019 | Sano | C22C 38/00 |
| 2019/0309398 | A1 | 10/2019 | Sano et al. | |

FOREIGN PATENT DOCUMENTS

| | | | |
|---|---|---|---|
| CN | 1450191 | A | 10/2003 |
| CN | 101443467 | A | 5/2009 |
| CN | 101646794 | A | 2/2010 |
| CN | 101724776 | A | 6/2010 |
| CN | 101999007 | A | 3/2011 |
| CN | 103459647 | A | 12/2013 |
| CN | 103459648 | A | 12/2013 |
| CN | 104011234 | A | 8/2014 |
| CN | 107250411 | A | 10/2017 |
| EP | 1149925 | A1 | 10/2001 |
| EP | 1350859 | A1 | 10/2003 |
| EP | 1559797 | A1 | 8/2005 |
| EP | 2088218 | A1 | 8/2009 |
| EP | 2182080 | A1 | 5/2010 |
| EP | 2453032 | A1 | 5/2012 |
| EP | 2530180 | A1 | 12/2012 |
| EP | 2599887 | A1 | 6/2013 |
| EP | 2631314 | A1 | 8/2013 |
| EP | 2865778 | A1 | 4/2015 |
| JP | 57-70257 | A | 4/1982 |
| JP | 58-42726 | A | 3/1983 |
| JP | 61-217529 | A | 9/1986 |
| JP | 9-49026 | A | 2/1987 |
| JP | 2-149646 | A | 6/1990 |
| JP | 3-180445 | A | 8/1991 |
| JP | 4-337026 | A | 11/1992 |
| JP | 5-59429 | A | 3/1993 |
| JP | 5-163590 | A | 6/1993 |
| JP | 7-90478 | A | 4/1995 |
| JP | 10-195591 | A | 7/1998 |
| JP | 2001-200331 | A | 7/2001 |
| JP | 2001-220648 | A | 8/2001 |
| JP | 2001-303186 | A | 10/2001 |
| JP | 2002-105595 | A | 4/2002 |
| JP | 2002-161340 | A | 6/2002 |
| JP | 2002-226943 | A | 8/2002 |
| JP | 2002-317246 | A | 10/2002 |
| JP | 2002-534601 | A | 10/2002 |
| JP | 2002-322540 | A | 11/2002 |
| JP | 2002-322541 | A | 11/2002 |
| JP | 2003-342684 | A | 12/2003 |
| JP | 2004-218077 | A | 8/2004 |
| JP | 2004-250749 | A | 9/2004 |
| JP | 2004-315857 | A | 11/2004 |
| JP | 2005-82842 | A | 3/2005 |
| JP | 2005-213566 | A | 8/2005 |
| JP | 2005-220440 | A | 8/2005 |
| JP | 2005-256115 | A | 9/2005 |
| JP | 2005-298924 | A | 10/2005 |
| JP | 2005-320619 | A | 11/2005 |
| JP | 2006-274318 | A | 10/2006 |
| JP | 2007-9322 | A | 1/2007 |
| JP | 2007-138238 | A | 6/2007 |
| JP | 2007-231398 | A | 9/2007 |
| JP | 2007-247046 | A | 9/2007 |
| JP | 2007-247049 | A | 9/2007 |
| JP | 2007-314828 | A | 12/2007 |
| JP | 2008-266726 | A | 11/2008 |
| JP | 2008-285748 | A | 11/2008 |
| JP | 2009-19265 | A | 1/2009 |
| JP | 2009-24227 | A | 2/2009 |
| JP | 2009-191360 | A | 8/2009 |
| JP | 2009-270171 | A | 11/2009 |
| JP | 2009-275238 | A | 11/2009 |
| JP | 2010-168651 | A | 8/2010 |
| JP | 2010-202976 | A | 9/2010 |
| JP | 2010-248601 | A | 11/2010 |
| JP | 2010-255090 | A | 11/2010 |
| JP | 2011-140671 | A | 7/2011 |
| JP | 2011-225941 | A | 11/2011 |
| JP | 2012-26032 | A | 2/2012 |
| JP | 2012-41573 | A | 3/2012 |
| JP | 2012-62561 | A | 3/2012 |
| JP | 2012-180569 | A | 9/2012 |
| JP | 2012-251201 | A | 12/2012 |
| JP | 2013-19048 | A | 1/2013 |
| JP | 5240037 | B2 | 7/2013 |
| JP | 2014-37595 | A | 2/2014 |
| JP | 5445720 | B1 | 3/2014 |
| JP | 2014-141703 | A | 8/2014 |
| JP | 5574070 | B1 | 8/2014 |
| JP | 5610103 | B2 | 10/2014 |
| JP | 2015-124411 | A | 7/2015 |
| JP | 2015-218352 | A | 12/2015 |
| JP | 2016-50334 | A | 4/2016 |
| KR | 10-2003-0076430 | A | 9/2003 |
| KR | 10-0778264 | B1 | 11/2007 |
| KR | 10-2009-0086401 | A | 8/2009 |
| TW | 201245465 | A1 | 11/2012 |
| TW | 201332673 | A1 | 8/2013 |
| TW | 201413009 | A | 4/2014 |
| TW | I467027 | B | 1/2015 |
| TW | I470091 | B | 1/2015 |
| WO | WO 2007/132548 | A1 | 11/2007 |
| WO | WO 2008/056812 | A1 | 5/2008 |
| WO | WO 2008/123366 | A1 | 10/2008 |
| WO | WO 2010/131303 | A1 | 11/2010 |
| WO | WO 2013/121963 | A1 | 8/2013 |
| WO | WO 2013/150687 | A1 | 10/2013 |
| WO | WO 2013/161090 | A1 | 10/2013 |
| WO | WO 2014/014120 | A1 | 1/2014 |
| WO | WO 2014/019844 | A1 | 2/2014 |
| WO | WO 2014/051005 | A1 | 4/2014 |
| WO | WO 2014/171427 | A1 | 10/2014 |

OTHER PUBLICATIONS

International Search Report for PCT/JP2015/055455 (PCT/ISA/210) dated May 19, 2015.

Kimura et al., "Misorientation Analysis of Plastic Deformation of Austenitic Stainless Steel by EBSD and X-Ray Diffraction Meth-

(56) References Cited

OTHER PUBLICATIONS ods", Transactions of the Japan Society of Mechanical Engineers. A, vol. 71, No. 712, 2005, pp. 1722-1728.
Written Opinion of the International Searching Authority for PCT/JP2015/055455 (PCT/ISA/237) dated May 19, 2015.
Chinese Office Action and Search Report, dated Jun. 25, 2018, for corresponding Chinese Application No. 201580076157.5, with an English translation of the Office Action.
International Preliminary Report on Patentability and English translation of the Written Opinion of the International Searching Authority (forms PCT/IB/373, PCT/ISA/237 and PCT/IB/338), dated Sep. 8, 2017, for corresponding International Application No. PCT/JP2015/055455.
"Development of Production Technology for Ultra Fine Grained Stels", Nakayama Steel WOrks, Ltd., NFG Product Introduction, 2000, total 11 pages, http://www.nakayama-steel.co.jp/menu/product/nfg.html.
Chinese Office Action and Search Report for Application No. 201580076254.4, dated May 30, 2018, with an English translation.
Chinese Office Action and Search Report for Chinese Application No. 201680011657.5, dated Jun. 5, 2018, with English translation.
English translation of the International Preliminary Report on Patentability and Written Opinion dated Aug. 31, 2017, in PCT International Application No. PCT/JP2015/054846.
English translation of the International Preliminary Report on Patentability and Written Opinion of the International Searching Authority (Forms PCT/IB/338, PCT/IB/373, and PCT/ISA/237), dated Feb. 14, 2019, for International Application No. PCT/JP2017/028478.
Extended European Search Report for European Application No. 17837115.9, dated Nov. 28, 2019.
Extended European Search Report dated Aug. 13, 2019, in European Patent Application No. 15882644.6.
Extended European Search Report dated Dec. 11, 2018, in European Patent Application No. 16752608.6.
Extended European Search Report, dated Aug. 13, 2018, for European Application No. 15882647.9.
Extended European Search Report, dated Dec. 19, 2018, for European Application No. 16755418.7.
Extended European Search Report, dated Nov. 29, 2019, for European Application No. 17837116.7.
International Preliminary Report on Patentability and English translation of the Written Opinion of the International Searching Authority for International Application No. PCT/JP2017/028477, dated Feb. 14, 2019.
International Search Report for PCT/JP2015/054846 dated May 19, 2015.
International Search Report for PCT/JP2015/054860 dated May 19, 2015.
International Search Report for PCT/JP2015/054876 dated May 19, 2015.
International Search Report for PCT/JP2015/055464 dated May 19, 2015.
International Search Report for PCT/JP2015/055071 (PCT/ISA/210) dated May 17, 2016.
International Search Report for PCT/JP2016/055074 (PCT/ISA/210) dated May 17, 2016.
International Search Report for PCT/JP2017/028477 (PCT/ISA/210) dated Oct. 31, 2017.
International Search Report for PCT/JP2017/028478 (PCT/ISA/210) dated Oct. 31, 2017.
Katoh et al., Seitetsu Kenkyu, 1984, No. 312, pp. 41-50.
Korean Notice of Allowance, dated Feb. 26, 2019, for Korean Application No. 10-2017-7023370, with an English translation.
Korean Office Action dated Nov. 7, 2018 for Korean Application No. 10-2017-7023367, with an English translation.
Korean Office Action for Korean Application No. 10-2017-7023370, dated Nov. 7, 2018, with an English translation.
Korean Office Action, dated Oct. 12, 2018, for Korean Application No. 10-2017-7024039, with an English translation.
Notice of Allowance dated Feb. 26, 2019, in Korean Patent Application No. 10-2017-7023367, with English translation.
Office Action for TW 105105137 dated Mar. 23, 2017.
Office Action dated Jun. 1, 2018, in Chinese Patent Application No. 201580075484.9.
Office Action dated May 30, 2018, in Chinese Patent Application No. 201680010703.X, with English translation.
Office Action dated Sep. 3, 2018, in Korean Patent Application No. 10-2017-7018427, with English translation.
Sugimoto et al., "Stretch-flangeability of a High-strength TRIP Type Bainitic Sheet Steel", ISIJ International, 2000, vol. 40, No. 9, pp. 920-926.
Taiwanese Office Action issued in TW Patent Application No. 105105213 dated Mar. 23, 2017.
Taiwanese Office Action issued in TW Patent Application No. 105105214 dated Mar. 23, 2017.
Takahashi, "Development of High Strength Steels for Automobiles", Nippon Steel Technical Report, Jul. 2003, No. 278, pp. 2-7.
U.S. Final Office Action, dated Aug. 20, 2019, issued in U.S. Appl. No. 15/551,171.
U.S. Final Office Action, dated Dec. 10, 2019, for U.S. Appl. No. 15/549,837.
U.S. Notice of Allowance, dated Dec. 27, 2019, for U.S. Appl. No. 15/551,863.
U.S. Notice of Allowance, dated Sep. 5, 2019, for U.S. Appl. No. 15/551,863.
U.S. Office Action, dated Apr. 29, 2019, issued in U.S. Appl. No. 15/551,171.
U.S. Office Action, dated Mar. 22, 2019, for U.S. Appl. No. 15/538,404.
U.S. Office Action, dated May 1, 2019, for U.S. Appl. No. 15/551,863.
U.S. Office Action, dated May 31, 2019, for U.S. Appl. No. 15/549,837.
U.S. Office Action, dated Nov. 18, 2019, for U.S. Appl. No. 15/538,404.
Written Opinion of the International Searching Authority for PCT/JP2015/054846 (PCT/ISA/237) dated May 19, 2015.
Written Opinion of the International Searching Authority for PCT/JP2015/054860 (PCT/ISA/237) dated May 19, 2015.
Written Opinion of the International Searching Authority for PCT/JP2016/055071 (PCT/ISA/237) dated May 17, 2016.
Written Opinion of the International Searching Authority for PCT/JP2016/055074 (PCT/ISA/237) dated May 17, 2016.
Written Opinion of the International Searching Authority for PCT/JP2017/028477 (PCT/ISA/237) dated Oct. 31, 2017.
Written Opinion of the International Searching Authority for PCT/JP2017/028478 (PCT/ISA/237) dated Oct. 31, 2017.
U.S Office Action, dated Mar. 17. 2020, for U.S. Appl. No. 15/551,171.
U.S. Office Action. dated Mar. 2, 2020, for U.S. Appl. No. 16/312,222.
U.S. Notice of Allowance, dated Apr. 17, 2020, for U.S. Appl. No. 15/551,863.

* cited by examiner

HOT-ROLLED STEEL SHEET

TECHNICAL FIELD

The present invention relates to a hot-rolled steel sheet excellent in workability, in particular, to a hot-rolled steel sheet excellent in stretch-flangeability.

BACKGROUND ART

In recent years, with respect to a demand for reduction in weight of various steel sheets having the purpose of improvement in fuel efficiency of an automobile, thinning through high strengthening of a steel sheet of an iron alloy or the like, application of light metal such as Al alloy or others have been promoted. However, the light metal such as Al alloy has an advantage that specific strength is higher than that of heavy metal such as steel but has a disadvantage that it is remarkably expensive, so that the application thereof is limited to special use. Accordingly, the high strengthening of the steel sheet is required to promote the reduction in weight of various members more inexpensively and extensively.

The high strengthening of the steel sheet is accompanied by a deterioration in a material property such as formability (workability) in general. Therefore, it is important to achieve the high strengthening without degrading material property in development of a high-strength steel sheet. In particular, stretch-flanging workability, burring workability, ductility, fatigue endurance, corrosion resistance, and the like are required of a steel sheet used for automobile members such as an inner sheet member, a structural member, and an underbody member, and it is important how these material properties and strength are exhibited at a high level in a well-balanced manner. For example, tough hole expandability (λ value) is required of a steel sheet used for automobile members such as a structural member and an underbody member, which occupy about 20% of body weight. This is because press forming mainly typified by stretch-flanging and burring is performed after blanking, opening and the like by shearing, punching and the like.

In the steel sheet used for such members, it is concerned that a flaw, a micro-crack, and others occur in an edge formed by the shearing or the punching, and a crack grows due to the generated flaw or micro-crack to cause fatigue fracture. Therefore, in the edge of the steel sheet, it is needed not to cause the flaw, the micro-crack, and the like in order to improve the fatigue endurance. As the flaw, micro-crack, and the like which occur in the edge, a crack is exemplified which occurs in parallel with the sheet surface. The crack is sometimes referred to as peeling. Conventionally, the peeling occurs with a probability of about 80% in a 540 MPa class steel sheet in particular, and occurs with a probability of about 100% in a 780 MPa class steel sheet. Further, the peeling occurs without correlating with a hole expansion ratio. For example, the peeling occurs when the hole expansion ratio is even 50% or even 100%.

For example, as a steel sheet excellent in the hole expandability (λ value), a steel sheet in which the main phase is ferrite and and which is precipitation-strengthened by fine precipitates of Ti, Nb, or the like and a manufacturing method thereof are reported.

A hot-rolled steel sheet having a purpose of high strength and improvement in stretch-flangeability is disclosed in Patent Literature 1. Hot-rolled steel sheets having a purpose of improvement in a stretch and stretch-flangeability are disclosed in Patent Literatures 2 and 3.

However, even by using the hot-rolled steel sheets disclosed in the patent literatures 1 to 3, it is difficult to sufficiently suppress the flaw and the micro-crack on the edge formed by the shearing, punching or the like. For example, the peeling occurs after punching in the hot-rolled steel sheets disclosed in Patent Literatures 2 and 3. A winding condition for manufacturing the hot-rolled steel sheet disclosed in the patent literature 1 is very tough. Moreover, because the hot-rolled steel sheets disclosed in Patent Literatures 2 and 3 contain Mo of 0.07% or more, which is an expensive alloying element, a manufacturing cost is high.

CITATION LIST

Patent Literature

Patent Literature 1: Japanese Laid-open Patent Publication No. 2002-105595

Patent Literature 2: Japanese Laid-open Patent Publication No. 2002-322540

Patent Literature 3: Japanese Laid-open Patent Publication No. 2002-322541

SUMMARY OF INVENTION

Technical Problem

An object of the present invention is to provide a hot-rolled steel sheet capable of obtaining excellent peeling resistance and excellent hole expandability.

Solution to Problem

The present inventors have obtained the following findings as a result of keen examination in order to achieve the above-described object.

1) Containing a specific amount of grains having an intragranular misorientation of 5° to 14° in all grains makes it possible to greatly improve hole expandability.

2) Containing Cr makes it possible to suppress precipitation of coarse and large-aspect ratio cementite, which makes the hole expandability deteriorate, and secure solid-solution C so as to balance excellent peeling resistance and excellent hole expandability with each other.

3) Containing Cr makes Cr solid-dissolve in carbide containing Ti and increases an amount of precipitation of a fine composite carbide, and allows precipitation strengthening.

4) Decreasing a Si content decreases a transformation temperature and allows precipitation of carbide containing Ti in a high-temperature region which causes a variation in strength of a steel sheet to be suppressed.

The invention is made based on such findings and the following hot-rolled steel sheet is regarded as a gist thereof.

(1)

A hot-rolled steel sheet comprising a chemical composition represented by, in mass %, C: 0.010% to 0.100%, Si: 0.30% or less, Mn: 0.40% to 3.00%, P: 0.100% or less, S: 0.030% or less, Al: 0.010% to 0.500%, N: 0.0100% or less, Cr: 0.05% to 1.00%, Nb: 0.003% to 0.050%, Ti: 0.003% to 0.200%,
Cu: 0.0% to 1.2%,
Ni: 0.0% to 0.6%,
Mo: 0.00% to 1.00%,
V: 0.00% to 0.20%,
Ca: 0.0000% to 0.0050%,
REM: 0.0000% to 0.0200%,
B: 0.0000% to 0.0020%, and
the balance: Fe and impurities,
wherein
relationships represented by Expression 1 and Expression 2 are satisfied, $$0.005 \leq [Si]/[Cr] \leq 2.000 \quad \text{Expression 1}$$

$$0.5 \leq [Mn]/[Cr] \leq 20.0 \quad \text{Expression 2}$$

([Si], [Cr], and [Mn] in the Expressions each mean a content (mass %) of each of the elements), and a proportion of grains having an intragranular misorientation of 5° to 14° in all grains is 20% or more by area ratio, the grain being defined as an area which is surrounded by a boundary having a misorientation of 15° or more and has a circle-equivalent diameter of 0.3 μm or more.

(2)

The hot-rolled steel sheet according to (1), comprising a microstructure represented by a volume ratio of cementite: 1.0% or less, an average grain diameter of cementite: 2.00 μm or less, a concentration of Cr contained in cementite: 0.5 mass % to 40.0 mass %, a proportion of cementite having a grain diameter of 0.5 μm or less and an aspect ratio of 5 or less in all cementite: 60 vol % or more, an average grain diameter of a composite carbide of Ti and Cr: 10.0 nm or less, and a number density of the composite carbide of Ti and Cr: $1.0\times10^{13}/mm^3$ or more.

(3)

The hot-rolled steel sheet according to (1) or (2), wherein, in the chemical composition, Cu: 0.2% to 1.2%,
Ni: 0.1% to 0.6%,
Mo: 0.05% to 1.00%, or
V: 0.02% to 0.20%, or
any combination thereof is satisfied.

(4)

The hot-rolled steel sheet according to any one of claims 1 to 3, wherein, in the chemical composition, Ca: 0.0005% to 0.0050%, or
REM: 0.0005% to 0.0200%, or
a combination thereof is satisfied.

(5)

The hot-rolled steel sheet according to any one of (1) to (4), wherein, in the chemical composition, B: 0.0002% to 0.0020% is satisfied.

(6)

The hot-rolled steel sheet according to any one of (1) to (5), comprising a galvanized film on a surface.

Advantageous Effects of Invention

According to the present invention, since a proportion of grains having an intragranular misorientation of 5° to 14°, a Cr content, a volume ratio of cementite, and others are appropriate, excellent peeling resistance and excellent hole expandability can be obtained.

DESCRIPTION OF EMBODIMENTS

Hereinafter, an embodiment of the present invention will be described.

First, a chemical composition of a hot-rolled steel sheet according to the embodiment of the present invention and a steel ingot or steel billet to be used for manufacture the same will be described. Though details will be described later, the hot-rolled steel sheet according to the embodiment of the present invention is manufactured through rough rolling of the ingot or slab, finish rolling, cooling, winding and others. Accordingly, the chemical composition of the hot-rolled steel sheet and the steel ingot or steel billet is one in consideration of not only characteristics of the hot-rolled steel sheet but also the above-stated processing. In the following description, "%" being a unit of a content of each element contained in the hot-rolled steel sheet means "mass %" unless otherwise stated. The hot-rolled steel sheet according to the present embodiment and the steel ingot or steel billet to be used for manufacture the same include a chemical composition represented by: C: 0.010% to 0.100%, Si: 0.30% or less, Mn: 0.40% to 3.00%, P: 0.100% or less, S: 0.030% or less, Al: 0.010% to 0.500%, N: 0.0100% or less, Cr: 0.05% to 1.00%, Nb; 0.003% to 0.050%, Ti: 0.003% to 0.200%, Cu: 0.0% to 1.2%, Ni: 0.0% to 0.6%, Mo: 0.00% to 1.00%, V: 0.00% to 0.20%, Ca: 0.0000% to 0.0050%, REM (rare earth metal): 0.0000% to 0.0200%, B: 0.0000% to 0.0020%, and the balance: Fe and impurities. As the impurities, ones included in a raw materials, such as ore and scrap, and ones included in a manufacturing process are exemplified.

(C: 0.010% to 0.100%)

C combines with Nb, Ti or others to form precipitates in a steel sheet and contributes to improvement of the strength by precipitation strengthening. C strengthens a grain boundary by existing on the grain boundary as solid-solution C and contributes to improvement in peeling resistance. When a C content is less than 0.010%, the effects by the above-described action cannot be sufficiently obtained. Therefore, the C content is 0.010% or more, and preferably 0.030% or more, and more preferably 0.040% or more. When the C content is more than 0.100%, an iron-based carbide, which becomes an origin of a crack in a hole expansion process, increases and a hole expansion ratio deteriorates. Therefore, the C content is 0.100% or less, and preferably 0.080% or less, and more preferably 0.070% or less.

(Si: 0.30% or less)

Si has an effect of suppressing precipitation of an iron-based carbide such as cementite in a material structure and contributing to improvement in ductility and hole expandability, but when a content thereof is excessive, a ferrite transformation easily occurs in a high-temperature region, and accordingly a carbide containing Ti easily precipitates in the high-temperature region. The precipitation of the carbide in the high-temperature region easily causes variations in an amount of precipitation, resulting in causing a material variation in strength, hole expandability, and the like. Further, the precipitation of the carbide in the high-temperature region decreases an amount of solid-solution C on the grain boundary and makes the peeling resistance deteriorate. Such a phenomenon is remarkable when a Si content is more than 0.30%. Therefore, the Si content is 0.30% or less, and preferably 0.10% or less, and more preferably 0.08% or less. A lower limit of the Si content is not particularly specified, but from the viewpoint of suppression of occurrence of scale-based defects such as a scale and a spindle-shaped scale, the Si content is preferably 0.01% or more, and more preferably 0.03% or more.

(Mn: 0.40% to 3.00%)

Mn contributes to improvement of the strength by solid-solution strengthening and quench strengthening. Also, Mn promotes a transformation in a para-equilibrium state at relatively low temperatures so as to make it easy to generate grains having an intragranular misorientation of 5° to 14°. When a Mn content is less than 0.40%, the effects by the above-described action cannot be sufficiently obtained. Therefore, the Mn content is 0.40% or more, preferably 0.50% or more, and more preferably 0.60% or more. When the Mn content is more than 3.00%, not only the effects by the above-described action are saturated but also hardenability increases excessively and formation of a continuous cooling transformation structure excellent in the hole expandability is difficult. Therefore, the Mn content is 3.00% or less, and preferably 2.40% or less, more preferably 2.00% or less.

(P: 0.100% or less)

P is not an essential element and is contained as an impurity in the steel, for example. P segregates to a grain boundary, and the higher a P content is, the lower toughness is. Therefore, the P content as low as possible is preferable. In particular, when the P content is more than 0.100%, the decreases in workability and weldability are remarkable. Accordingly, the P content is 0.100% or less. From the viewpoint of improvement in the hole expandability and the weldability, the P content is preferably 0.050% or less, and more preferably 0.030% or less. A time and a cost are spent in reducing the P content, and when reduction to less than 0.005% is intended, the time and the cost increase remarkably. Therefore, the P content may be 0.005% or more.

(S: 0.030% or less)

S is not an essential element and is contained as an impurity in the steel sheet, for example. S causes a crack in hot rolling and generates an A type inclusion leading to decrease in the hole expandability. Therefore, a S content as low as possible is preferable. In particular, when the S content is more than 0.030%, the adverse effects are remarkable. Accordingly, the S content is 0.030% or less. From the viewpoint of improvement in the hole expandability, the S content is preferably 0.010% or less, and more preferably 0.005% or less. A time and a cost are spent in reducing the S content, and when reduction to less than 0.001% is intended, the time and the cost increase remarkably. Therefore, the S content may be 0.001% or more.

(Al: 0.010% to 0.500%)

Al acts as a deoxidizer at a steelmaking stage. When an Al content is less than 0.010%, the above effect cannot be sufficiently obtained. Therefore, the Al content is 0.010% or more, and preferably 0.020% or more, and more preferably 0.025% or more. When the Al content is more than 0.500%, the effects by the above-described action are saturated, and a cost needlessly is high. Therefore, the Al content is 0.500% or less. When the Al content is more than 0.100%, a non-metal inclusion increases and the ductility and the toughness sometimes deteriorate. Therefore, the Al content is preferably 0.100% or less, and more preferably 0.050% or less.

(N: 0.0100% or less)

N is not an essential element and is contained as an impurity in the steel sheet, for example. N combines with Ti, Nb or others to form nitride. The nitride precipitates at a relatively high temperature and easily becomes coarse, and has a possibility of becoming an origin of a crack in the hole expansion process. Further, the nitride is preferably fewer in order to precipitate Nb and Ti as a carbide as described later. Therefore, a N content is 0.0100% or less. The N content is preferably 0.0060% or less, and more preferably 0.0040% or less. A time and a cost are spent in reducing the N content, and when reduction to less than 0.0010% is intended, the time and the cost increase remarkably. Therefore, the N content may be 0.0010% or more.

(Cr: 0.05% to 1.00%)

Cr suppresses a pearlite transformation and controls a size and a form of cementite by solid-dissolving in the cementite so as to make it possible to improve the hole expandability. Cr also solid-dissolves in a carbide containing Ti and increases a number density of a precipitate so as to increase precipitation strengthening. When a Cr content is less than 0.05%, the effects by the above-described action cannot be sufficiently obtained. Therefore, the Cr content is 0.05% or more, preferably 0.20% or more, and more preferably 0.40% or more. When the Cr content is more than 1.00%, the effects by the above-described action are saturated and not only a cost needlessly is high but also a decrease in chemical conversion treatability is remarkable. Therefore, the Cr content is 1.00% or less.

(Nb: 0.003% to 0.050%)

Nb finely precipitates as a carbide in the cooling after the rolling completion or after the winding and improves strength by precipitation strengthening. Moreover, Nb forms carbide so as to fix C, thereby suppressing generation of cementite, which is harmful to the hole expandability. When a Nb content is less than 0.003%, the effects by the above-described action cannot be sufficiently obtained. Therefore, the Nb content is 0.003% or more, and preferably 0.005% or more, and more preferably 0.008% or more. When the Nb content is more than 0.050%, the effects by the above-described action are saturated and not only a cost needlessly is high but also an increase in the precipitated carbide decreases an amount of solid-solution C on the grain boundary and sometimes makes the peeling resistance deteriorate. Therefore, the Nb content is 0.050% or less, and preferably 0.040% or less, and more preferably 0.020% or less.

(Ti: 0.003% to 0.200%)

Ti finely precipitates as a carbide in the cooling after the rolling completion or after the winding and improves strength by precipitation strengthening similarly to Nb. Moreover, Ti forms carbide so as to fix C, thereby suppressing generation of cementite, which is harmful to the hole expandability. When a Ti content is less than 0.003%, the effects by the above-described action cannot be sufficiently obtained. Therefore, the Ti content is 0.003% or more, and preferably 0.010% or more, and more preferably 0.050% or more. When the Ti content is more than 0.200%, the effects by the above-described action are saturated and not only a cost needlessly is high but also an increase in the precipitated carbide decreases an amount of solid-solution C on the grain boundary and sometimes makes the peeling resistance deteriorate. Therefore, the Ti content is 0.200% or less, and preferably 0.170% or less, and more preferably 0.150% or less.

Cu, Ni, Mo, V, Ca, REM, and B are not essential elements but are optional elements which may be appropriately contained up to specific amounts in the hot-rolled steel sheet and the steel ingot or steel billet.

(Cu: 0.0% to 1.2%, Ni: 0.0% to 0.6%, Mo: 0.00% to 1.00%, V: 0.00% to 0.20%)

Cu, Ni, Mo, and V have an effect of improving strength of the hot-rolled steel sheet by precipitation strengthening or solid-solution strengthening. Accordingly, Cu, Ni, Mo, or V, or any combination thereof may be contained. In order to obtain the effects sufficiently, a Cu content is preferably 0.2% or more, a Ni content is preferably 0.1% or more, a Mo content is preferably 0.05% or more, and a V content is preferably 0.02% or more. However, when the Cu content is more than 1.2%, the Ni content is more than 0.6%, the Mo content is more than 1.00%, or the V content is more than 0.20%, the effects by the above-described action are saturated and a cost needlessly is high. Therefore, the Cu content is 1.2% or less, the Ni content is 0.6% or less, the Mo content is 1.00% or less, and the V content is 0.20% or less. Thus, Cu, Ni, Mo, and V are the optional elements, and "Cu: 0.2% to 1.2%", "Ni: 0.1% to 0.6%", "Mo: 0.05% to 1.00%", or "V: 0.02% to 0.20%", or any combination thereof is preferably satisfied.

(Ca: 0.0000% to 0.0050%, REM: 0.0000% to 0.0200%)

Ca and REM are elements which control a form of the non-metal inclusion, which becomes an origin of fracture and causes a deterioration of the workability, and improve the workability. Accordingly, Ca or REM, or both of them may be contained. In order to obtain the effects sufficiently, a Ca content is preferably 0.0005% or more, and a REM content is preferably 0.0005% or more. However, when the Ca content is more than 0.0050% or the REM content is more than 0.0200%, the effects by the above-described action are saturated and a cost needlessly is high. Therefore, the Ca content is 0.0050% or less, and the REM content is 0.0200% or less. Thus, Ca and REM are optional elements, and "Ca: 0.0005% to 0.0050%" or "REM: 0.0005% to 0.0200%", or both of them is preferably satisfied. REM represents elements of 17 kinds in total of Sc, Y, and lanthanoid, and the "REM content" means a content of a total of these 17 kinds of elements.

(B: 0.0000% to 0.0020%)

B segregates to a grain boundary, and when B exists with solid-solution C on the grain boundary, B has an effect of increasing strength of grain boundary. B also has an effect of improving the hardenability and making the formation of the continuous cooling transformation structure, which is a microstructure desirable for the hole expandability, easy. Accordingly, B may be contained. In order to obtain the effects sufficiently, a B content is preferably 0.0002% or more, and more preferably 0.0010% or more. However, when the B content is more than 0.0020%, slab cracking occurs. Therefore, the B content is 0.0020% or less. Thus, B is an optional element, and "B: 0.0002% to 0.0020%" is preferably satisfied.

In the present embodiment, relationships represented by Expression 1 and Expression 2 are satisfied.

$$0.005 \leq [Si]/[Cr] \leq 2.000 \quad \text{Expression 1}$$

$$0.5 \leq [Mn]/[Cr] \leq 20.0 \quad \text{Expression 2}$$

([Si], [Cr], and [Mn] in the Expressions each mean a content (mass %) of each of the elements.)

In the present embodiment, it is very important to control a proportion of grains having an intragranular misorientation of 5° to 14°, a size and an amount of precipitation of a composite carbide of Ti and Cr, and a size and a form of cementite. Precipitation behavior of the composite carbide of Ti and Cr and the cementite depends on a balance of a content between Si and Cr. When a ratio of the contents ([Si]/[Cr]) is less than 0.005, the hardenability increases excessively, and the proportion of the grains having an intragranular misorientation of 5° to 14° decreases and the composite carbide of Ti and Cr does not easily precipitate in a low-temperature region. Therefore, [Si]/[Cr] is 0.005 or more, preferably 0.010 or more, and more preferably 0.030 or more. When the ratio of the contents ([Si]/[Cr]) is more than 2.000, the proportion of the grains having an intragranular misorientation of 5° to 14° decreases and the precipitation of the composite carbide of Ti and Cr in a high-temperature range causes the material variation, and an amount of solid-solution C decreases and the peeling resistance deteriorates. Moreover, when the ratio of the contents ([Si]/[Cr]) is more than 2.000, coarse cementite precipitates and the hole expandability deteriorates. Therefore, [Si]/[Cr] is 2.000 or less, preferably 1.000 or less, and more preferably 0.800 or less.

Mn and Cr enhance the hardenability and suppress the ferrite transformation at high temperatures, thereby making it easy to generate grains having an intragranular misorientation of 5° to 14° and suppressing the precipitation of the composite carbide of Ti and Cr, resulting in contribution to stabilization of material. Meanwhile, effects of precipitation control of cementite and enhancement of the hardenability are different between Mn and Cr. When a ratio of the contents ([Mn]/[Cr]) is less than 0.5, the hardenability increases excessively, the proportion of the grains having an intragranular misorientation of 5° to 14° decreases, and the precipitation of the composite carbide of Ti and Cr does not easily occur in a low-temperature region. Therefore, [Mn]/[Cr] is 0.5 or more, preferably 1.0 or more, and more preferably 3.0 or more. When the ratio of the contents ([Mn]/[Cr]) is more than 20.0, control in specific size and form of cementite is difficult. Therefore, [Mn]/[Cr] is 20.0 or less, preferably 10.0 or less, and more preferably 8.0 or less.

Next, characteristics of a grain in the hot-rolled steel sheet according to the present embodiment will be described. In the hot-rolled steel sheet according to this embodiment, a proportion of grains having an intragranular misorientation of 5° to 14° in all grains is 20% or more by area ratio, when the grain is defined as an area which is surrounded by a boundary having a misorientation of 15° or more and has a circle-equivalent diameter of 0.3 μm or more.

The proportion of the grains having an intragranular misorientation of 5° to 14° in all the grains can be measured by the following method. First, a crystal orientation of a rectangular region having a length in a rolling direction (RD) of 200 μm and a length in a normal direction (ND) of 100 μm around a ¼ depth position (¼t portion) of a sheet thickness t from the surface of the steel sheet within a cross section parallel to the rolling direction, is analyzed by an electron back scattering diffraction (EBSD) method at intervals of 0.2 μm, and crystal orientation information on this rectangular region is acquired. In the EBSD method, irradiating a sample inclined at a high angle in a scanning electron microscope (SEM) with an electron beam, photographing a Kikuchi pattern formed by backscattering with a high-sensitive camera, and performing computer image processing allow a quantitative analysis of a microstructure and a crystal orientation on a surface of a bulk sample. This EBSD analysis is performed at a speed of 200 points/sec to 300 points/sec using, for example, a thermal electric field emission scanning electron microscope (JSM-7001F manufactured by JOEL Ltd.) and an EBSD analyzer equipped with an EBSD detector (HIKARI detector manufacture by TSL Co., Ltd.). Then, a grain is defined as a region surrounded by a boundary having a misorientation of 15° or more and having a circle-equivalent diameter of 0.3 μm or more from the acquired crystal orientation information, the intragranular misorientation is calculated, and the proportion of grains having an intragranular misorientation of 5° to 14° in all grains is obtained. The thus-obtained proportion is an area fraction, and is equivalent also to a volume fraction. The "intragranular misorientation" means "Grain Orientation Spread (GOS)" being an orientation spread in a grain. The intragranular misorientation is obtained as an average value of misorientation between the crystal orientation being a base and crystal orientations at all measurement points in the grain as described also in a document "KIMURA Hidehiko, WANG Yun, AKINIWA Yoshiaki, TANAKA Keisuke "Misorientation Analysis of Plastic Deformation of Stainless Steel by EBSD and X-ray Diffraction Methods", Transactions of the Japan Society of Mechanical Engineers. A, Vol. 71, No. 712, 2005, pp. 1722-1728." Besides, an orientation obtained by averaging the crystal orientations at all of the measurement points in the grain is used as "the crystal orientation being a base". The intragranular misorientation can be calculated, for example, by using software "OIM Analysis™ Version 7.0.1" attached to the EBSD analyzer.

The crystal orientation in a grain is considered to have a correlation with a dislocation density included in the grain. Generally, an increase in dislocation density in a grain brings about improvement in strength while decreasing workability. However, the grains having an intragranular misorientation of 5° to 14° can improve the strength without decreasing workability. Therefore, in the hot-rolled steel sheet according to the present embodiment, the proportion of the grains having an intragranular misorientation of 5° to 14° is 20% or more. A grain having an intragranular misorientation of less than 5° is difficult to increase the strength though excellent in workability, and a grain having an average misorientation in the grain of more than 14° does not contribute to improvement of stretch-flangeability because it is different in deformability in the grain. When the proportion of the grains having an intragranular misorientation of 5° to 14° is less than 20% by area ratio, the stretch-flangeability and the strength decrease, and excellent stretch-flangeability and strength cannot be obtained. Accordingly, the proportion is 20% or more. Since the grains having an intragranular misorientation of 5° to 14° are effective in the improvement in the stretch-flangeability in particular, an upper limit of the proportion is not particularly specified.

Next, a desirable microstructure of the hot-rolled steel sheet according to the present embodiment will be described. The hot-rolled steel sheet according to the present embodiment preferably has a microstructure represented by, a volume ratio of cementite: 1.0% or less, an average grain diameter of cementite: 2.00 μm or less, a concentration of Cr contained in cementite: 0.5 mass % to 40.0 mass %, a proportion of cementite having a grain diameter of 0.5 μm or less and an aspect ratio of 5 or less in all cementite: 60 vol % or more, an average grain diameter of a composite carbide of Ti and Cr: 10.0 nm or less, and a number density of a composite carbide of Ti and Cr: $1.0\times10^{13}/mm^3$ or more.

(Volume ratio of cementite: 1.0% or less, average grain diameter of cementite: 2.00 μm or less)

Stretch-flanging workability and burring workability represented by a hole expansion ratio are affected by a void, which becomes an origin of a crack occurring in a punching process or a shearing process. The void easily occurs in a position where a hardness difference is large in a metal structure, and when cementite is included in particular, a matrix grain is subjected to excessive stress concentration at an interface between the cementite and the matrix and the void occurs there. When the volume ratio of cementite is more than 1.0%, the hole expandability easily deteriorates. Also when the average grain diameter of cementite is more than 2.00 μm, the hole expandability easily deteriorates. Therefore, the volume ratio of cementite is preferably 1.0% or less, and the average grain diameter of cementite is preferably 2.00 μm or less. Lower limits of the volume ratio and the average grain diameter of cementite are not particularly specified.

(Concentration of Cr contained in cementite: 0.5 mass % to 40.0 mass %)

Cr solid-dissolves in cementite and controls the size and the form of cementite. When the concentration of Cr contained in the cementite is 0.5 mass % or more, the cementite becomes relatively small to a matrix grain, and anisotropy with respect to deformation is small. Accordingly, since stress does not easily concentrate dynamically and the void accompanying the stress concentration does not easily occur, the hole expandability improves. Therefore, the concentration of Cr contained in cementite is preferably 0.5 mass % or more. When the concentration of Cr contained in cementite is more than 40.0 mass %, the hole expandability and the peeling resistance are sometimes made to deteriorate. Therefore, the concentration of Cr contained in cementite is preferably 40.0 mass % or less.

(Proportion of cementite having a grain diameter of 0.5 μm or less and aspect ratio of 5 or less in all cementite: 60 vol % or more)

When the proportion of cementite having the grain diameter of 0.5 μm or less and the aspect ratio of 5 or less in all cementite is 60 vol % or more, cementite becomes relatively small to the matrix grain, and the anisotropy with respect to the deformation is small. Accordingly, since the stress does not easily concentrate dynamically and the void accompanying the stress concentration does not easily occur, the hole expandability improves. Therefore, the proportion is preferably 60 vol % or more. The proportion may also be regarded as a proportion of total volume of cementite having the grain diameter of 0.5 μm or less and the aspect ratio of 5 or less with respect to total volume of all cementite.

Here, a measuring method of the volume ratio, the grain diameter, and the aspect ratio of cementite, and the concentration of Cr contained in cementite will be described. First, a sample for transmission electron microscope is prepared from a ¼ depth position (¼ t portion) of a sheet thickness t from a steel sheet surface of a test piece cut out from a ¼ W position or a ¾ W position of a sheet width of a steel sheet of a sample material. Next, the sample for transmission electron microscope is observed at an acceleration voltage of 200 kV using a transmission electron microscope, and cementite is specified from a diffraction pattern thereof. Thereafter, a concentration of Cr contained in the cementite is measured using an energy dispersive X-ray spectrometry attached to the transmission electron microscope. Further, an observation of arbitrary ten fields of view is made at a magnification of 5000 times to obtain an image thereof. Then, a volume ratio, a grain diameter, and an aspect ratio of each cementite is obtained from this image using image analyzing software, and further a proportion of the cementite having the grain diameter of 0.5 μm or less and the aspect ratio of 5 or less in all the cementite is obtained. The proportion obtained by this method is a proportion (area fraction) of an area in an observation surface, and the proportion of the area is equivalent to a proportion of volume. When the volume ratio and the grain diameter of cementite are measured by this method, a measuring limit of the volume ratio is about 0.01%, and a measuring limit of the grain diameter is about 0.02 μm. As image-processing software, for example, "Image-Pro" made by Media Cybernetics Inc. United States of America may be used.

(Average grain diameter of a composite carbide of Ti and Cr: 10.0 nm or less, Number density of a composite carbide of Ti and Cr: $1.0\times10^{13}/mm^3$ or more)

The composite carbide of Ti and Cr contributes to precipitation strengthening. However, when the average grain diameter of this composite carbide is more than 10.0 nm, an effect of the precipitation strengthening cannot be sometimes sufficiently obtained. Therefore, the average grain diameter of this composite carbide is preferably 10.0 nm or less, and more preferably 7.0 nm or less. A lower limit of the average grain diameter of this composite carbide is not particularly specified, but when the average grain diameter is less than 0.5 nm, a mechanism of the precipitation strengthening changes from an Orowan mechanism to a Cutting mechanism, and there is a possibility that an effect of desirable precipitation strengthening cannot be obtained. Therefore, the average grain diameter of this composite carbide is preferably 0.5 nm or more. Further, when the number density of this composite carbide is less than $1.0\times10^{13}/mm^3$, a sufficient effect of precipitation strengthening cannot be obtained and desired tensile strength (TS) cannot be sometimes obtained while securing the ductility, the hole expandability, and the peeling resistance. Therefore, the number density of this composite carbide is preferably $1.0\times10^{13}/mm^3$ or more, and more preferably $5.0\times10^{13}/mm^3$ or more.

Cr solid-dissolves in TiC and has an effect of controlling a form of the composite carbide and increasing the number density. When a solid solution amount of Cr in the composite carbide is less than 2.0 mass %, this effect cannot be sometimes sufficiently obtained. Therefore, the solid solution amount is preferably 2.0 mass % or more. When the solid solution amount is more than 30.0 mass %, a coarse composite carbide is generated and the sufficient precipitation strengthening cannot sometimes obtained. Therefore, this solid solution amount is preferably 30.0 mass % or less.

Here, a measuring method of a grain diameter and the number density of the composite carbide, and a concentration (solid solution amount) of Cr contained in the composite carbide will be described. First, a needle-shaped sample is prepared from a sample material by cutting and electropolishing. At this time, focused ion beam milling may be utilized with the electropolishing as necessary. Then, a three-dimensional distribution image of a composite carbide is obtained from the needle-shaped sample by a three-dimensional atom probe measurement method. The three-dimensional atom probe measurement method allows integrated data to be restored and obtained as the three-dimensional distribution image of real atoms in real space. In a measurement of a grain diameter of the composite carbide, a diameter when the composite carbide is regarded as a spherical body is found from the number of constituent atoms and a lattice constant of the composite carbide of an observational object, and this is regarded as the grain diameter of the composite carbide. Then, only a composite carbide having the grain diameter of 0.5 nm or more is regarded as an object for measuring the average grain diameter and the number density. Next, the number density of the composite carbide is obtained from volume of the three-dimensional distribution image of the composite carbide and the number of composite carbides. Diameters of arbitrary 30 or more composite carbides are measured, and an average value thereof is regarded as an average grain diameter of the composite carbide. The number of atoms of each of Ti and Cr in the composite carbide is measured to obtain a concentration of Cr contained in the composite carbide from a ratio between both the numbers. In obtaining the concentration of Cr, the average value of arbitrary 30 or more composite carbides may be found.

A microstructure of the matrix of the hot-rolled steel sheet according to the present embodiment is not particularly limited, but is preferably a continuous cooling transformation structure (Zw) in order to obtain more excellent hole expandability. The microstructure of the matrix may include polygonal ferrite (PF) having a volume ratio of 20% or less. When the polygonal ferrite having the volume ratio of 20% or less is included, the workability such as the hole expandability and the ductility represented by uniform elongation can be balanced more securely with each other. The volume ratio of the microstructure is equivalent to an area fraction in a measurement field of view.

Here, the continuous cooling transformation structure (Zw) means a transformation structure which is at an intermediate stage between a microstructure including polygonal ferrite or pearlite generated by a diffusive mechanism and martensite generated by a shearing mechanism without diffusing as mentioned in Bainite Research Committee, Society on Basic Research, the Iron and Steel Institute of Japan/series; Recent Research on the Bainite Structure of Low Carbon Steel and its Transformation Behavior-Final Report of the Bainite Research committee-(1994 the Iron and Steel Institute of Japan) (hereinafter, which is sometimes referred to as a reference.). The continuous cooling transformation structure (Zw) is mainly constituted of bainitic ferrite ($\alpha^o$ B), granular bainitic ferrite ($\alpha$B), and quasi-polygonal ferrite ($\alpha$q) and further includes a small amount of retained austenite ($\gamma$r) and martensite-austenite (MA) as mentioned in page 125 to page 127 in the reference as an optical microscope observation structure. Quasi-polygonal ferrite, whose internal structure does not appear by etching similarly to polygonal ferrite but whose shape is acicular, is a structure which is clearly distinguished from polygonal ferrite. When lq denotes a circumferential length of a targeted grain and dq denotes a circle-equivalent diameter thereof, a grain in which a ratio (lq/dq) therebetween is 3.5 or more can be regarded as the quasi-polygonal ferrite. The continuous cooling transformation structure (Zw) includes one or more of bainitic ferrite, granular bainitic ferrite, quasi-polygonal ferrite, retained austenite, and martensite-austenite. A total amount of the retained austenite and the martensite-austenite is preferably 3 vol % or less.

Here, a discriminating method of the continuous cooling transformation structure (ZW) will be described. In general, the continuous cooling transformation structure (Zw) can be discriminated by optical microscope observation by etching using a nital reagent. When the discrimination by the optical microscope observation is difficult, the discrimination may be performed by the EBSD method. In the discrimination of the continuous cooling transformation structure (Zw), the one capable of being discriminated by an image subjected to mapping with a misorientation of each packet thereof being 15° may be defined as the continuous cooling transformation structure (Zw). as a matter of convenience.

The hot-rolled steel sheet according to the present embodiment can be obtained by a manufacturing method including such a hot-rolling step and a cooling step as described below, for example.

A steel ingot or steel billet may be prepared by any method. For example, melting using a blast furnace, a converter, an electric furnace, or the like is performed, and adjustment of components is performed so that the above-described chemical composition can be obtained in various secondary refining, to preform casting. As the casting, besides normal continuous casting or casting by an ingot method, thin slab casting or the like may be performed. Scrap may be used in material. Further, when a slab is obtained by the continuous casting, a high-temperature cast slab may be directly sent as it is to a hot rolling mill or may be reheated in a heating furnace after cooling to room temperature and subjected to hot rolling.

<Regarding Hot-Rolling Step>

In the hot-rolling step, a hot-rolled steel sheet is produced by heating a steel ingot or steel billet having the above-described chemical components and performing hot rolling. A heating temperature of the steel ingot or steel billet (slab heating temperature) is preferably a temperature $SRT_{min}$° C. represented by the Expression 3 or more to 1260° C. or less.

$$SRT_{min}=7000/\{2.75-\log([Ti]\times[C])\}-273 \quad \text{Expression 3}$$

Here, [Ti] and [C] in the Expression 3 each denotes a content of each of the elements by mass %.

The hot-rolled steel sheet according to the present embodiment contains Ti. When the slab heating temperature is less than $SRT_{min}$° C., Ti is not sufficiently put into solution. When Ti is not put into solution in heating a slab, it becomes difficult to finely precipitate Ti as a carbide and improve strength of steel by precipitation strengthening. Further, it becomes difficult to obtain an effect of suppressing generation of cementite harmful to the hole expandability by fixing C with generation of a Ti carbide. On the other hand, when the heating temperature in a slab heating step is more than 1260° C., a yield is reduced by scale off. Therefore, the heating temperature is preferably $SRT_{min}$° C. or more to 1260° C. or less.

After heating the slab from $SRT_{min}$° C. or more to 1260° C. or less, rough rolling is performed without particular waiting. When a finish temperature of the rough rolling is less than 1050° C., a Nb carbide and a composite carbide of Ti and Cr precipitate in austenite coarsely, thereby making the workability of the steel sheet deteriorate. Further, hot deformation resistance in the rough rolling increases, and there is a possibility of hindering operation of the rough rolling. Therefore, the finish temperature of the rough rolling is 1050° C. or more. An upper limit of the finish temperature is not particularly specified but is preferably 1150° C. That is because when the finish temperature is more than 1150° C., a secondary scale generated in the rough rolling grows too much and it sometimes becomes difficult to remove the scale in descaling or finish rolling to be performed later. When a cumulative reduction ratio of the rough rolling is less than 40%, it is impossible to sufficiently destroy a solidification structure in casting and make a crystal structure equiaxial, which inhibits the workability of the steel sheet. Therefore, the cumulative reduction ratio of the rough rolling is 40% or more.

A plurality of rough bars obtained by the rough rolling may be joined to each other before the finish rolling so as to continuously perform endless rolling in the finish rolling. In this case, the rough bars may be wound into a coil shape once, stored in a cover having a heat insulating function as necessary, and rewound again, thereafter performing joining.

Between a roughing mill used for the rough rolling and a finishing mill used for the finish rolling, or among the respective stands of the finishing mill, the rough bar may be heated using a heating apparatus capable of controlling variations in temperature in a rolling direction, a sheet width direction, and a sheet thickness direction of the rough bar. As a manner of the heating apparatus, gas heating, energization heating, induction heating, and the like can be variously cited. Performing such heating makes it possible to control the temperature in the rolling direction, the sheet width direction, and the sheet thickness direction of the rough bar in small variations in the hot rolling.

In order to control the proportion of grains having an intragranular misorientation of 5° to 14° in 20% or more, cumulative strain in the last three stages of the finish rolling is preferably 0.5 to 0.6 and on that basis, cooling is performed preferably under the later-described condition. This is because, the grains having an intragranular misorientation of 5° to 14° are generated by transformation in a para-equilibrium state at relatively low temperatures, so that controlling a dislocation density of austenite before transformation to a certain range and controlling a cooling rate thereafter to a certain range allow a promotion of the generation of these grains. That is, because controlling the cumulative strain in the last three stages of the finish rolling and the cooling thereafter allows control of a nucleation frequency of the grains having an intragranular misorientation of 5° to 14° and a growth rate thereafter, it is also possible to control the proportion of these grains as a result. More specifically, the dislocation density of austenite introduced by the finish rolling relates to the nucleation frequency, and the cooling rate after the rolling relates to the growth rate.

When the cumulative strain in the last three stages of the finish rolling is less than 0.5, the dislocation density of austenite to be introduced is not sufficient, and the proportion of the grains having an intragranular misorientation of 5° to 14° becomes less than 20%. Accordingly, this cumulative strain is preferably 0.5 or more. On the other hand, when the cumulative strain in the last three stages of the finish rolling is more than 0.6, recrystallization of austenite occurs during the finish rolling and a stored dislocation density in the transformation decreases. Also in this case, the proportion of the grains having an intragranular misorientation of 5° to 14° becomes less than 20%. Accordingly, this cumulative strain is preferably 0.6 or less.

The here-described cumulative strain ($\varepsilon_{eff}$) in the last three stages of the finish rolling can be found by the Expression 4.

$$\varepsilon_{eff}=\Sigma\varepsilon_i(t,T) \quad \text{Expression 4}$$

here is, $\varepsilon_i$ (t, T)$=\varepsilon_{i0}/\exp\{(t/\tau_R)^{2/3}\}$, $\tau_R=\tau_0\cdot\exp(Q/RT)$ $\tau_0=8.46\times10^{-6}$,

Q=183200 J,

R=8.314 J/K·mol, $\varepsilon_{i0}$ denotes logarithmic strain in reduction, t denotes cumulative time until just before cooling in the stages, and T denotes a rolling temperature in the stages.

A finish temperature (rolling finish temperature) of the finish rolling is preferably Ar3 point or more. When the rolling finish temperature is less than Ar3 point, the dislocation density of austenite before the transformation increases excessively, and it becomes difficult to control the proportion of the grains having an intragranular misorientation of 5° to 14° in 20% or more.

The finish rolling is preferably performed using a tandem mill, in which a plurality of rolling mills are disposed linearly and which performs continuous rolling in one direction to obtain a predetermined thickness. When the finish rolling is performed using the tandem mill, a steel sheet temperature in the finish rolling is preferably controlled so as to be in a range of Ar3 or more to Ar3+150° C.

or less by performing the cooling (inter-stand cooling) between a rolling mill and a rolling mill. A temperature of the steel sheet in the finish rolling exceeding Ar3+150° C. causes too large grain diameters, so than it is concerned that the toughness deteriorates. Performing the inter-stand cooling under such a condition as described above makes it easy to limit the dislocation density range of austenite before the transformation and control the proportion of the grains having an intragranular misorientation of 5° to 14° in 20% or more.

The Ar3 point is calculated by the Expression 5 considering an effect on a transformation point due to the reduction based on the chemical components of the steel sheet.

$$\text{Ar3 point (° C.)}=970-325\times[C]+33\times[Si]+287\times[P]+40\times[Al]-92\times([Mn]+[Mo]+[Cu])-46\times([Cr]+[Ni]) \quad \text{Expression 5}$$

Here, [C], [Si], [P], [Al], [Mn], [Mo], [Cu], [Cr], and [Ni] denotes a content (mass %) of C, Si, P, Al, Mn, Mo, Cu, Cr, and Ni, respectively. An element which is not contained is calculated as 0%.

Further, in the finish rolling, the Expression 6 is preferably satisfied.

$$\frac{0.018\,[Nb]+0.01\,[Ti]}{\exp\left(\frac{-6080}{T+273}\right)} \le t \le \frac{0.054[Nb]+0.07[Ti]}{\exp\left(\frac{-6080}{T+273}\right)} \quad \text{Expression 6}$$

Here, [Nb] and [Ti] denotes a content of Nb and Ti by mass %, respectively, and t denotes a time (sec) from a rolling completion in a stage one before the last stage to a rolling start in the last stage, and T denotes a rolling completion temperature (C.°) in the stage one before the last stage.

When the above-described Expression is satisfied, from the rolling completion in the stage one before the last stage to the rolling start in the last stage, the recrystallization of austenite is promoted and grain growth of austenite is inhibited. Therefore, miniaturization of recrystallized austenite grains during the rolling is performed, and this makes it easier to obtain a microstructure suitable for the ductility and the hole expandability.

<Regarding Cooling Step>

The cooling is performed to the hot-rolled steel sheet after the hot rolling. It is desirable to, in the cooling step, perform the cooling of the hot-rolled steel sheet in which the hot rolling is completed (first cooling) at an average cooling rate of more than 15° C./sec to a temperature zone of 500° C. to 650° C., and next perform the cooling of the above-described steel sheet (second cooling) on condition that the average cooling rate to 450° C. is 0.008° C./sec to 1.000° C./sec.

(First Cooling)

In a first cooling, a phase transformation from austenite and a conflict between precipitation nucleation of cementite and precipitation nucleation of a Nb carbide and a composite carbide of Ti and Cr occur. Then, when the average cooling rate in the first cooling is 15° C./sec or less, it becomes difficult to control the proportion of the grains having an intragranular misorientation of 5° to 14° in 20% or more, and because generation of a precipitation nucleus of cementite has priority, the cementite grows in the subsequent second cooling and the hole expandability deteriorates. Therefore, the average cooling rate is more than 15° C./sec. An upper limit of the average cooling rate is not particularly specified, but from the viewpoint of suppressing a sheet warp due to thermal strain, the average cooling rate is preferably 300° C./sec or less. Further, when the cooling at more than 15° C./sec is stopped at more than 650° C., it becomes difficult to control the proportion of the grains having an intragranular misorientation of 5° to 14° in 20% or more and cementite easily occurs due to a shortage of cooling, so that a desired microstructure cannot be obtained. Therefore, this cooling is performed to 650° C. or less. When the cooling at more than 15° C./sec is performed to less than 500° C., sufficient precipitation does not occur in the second cooling thereafter, so that it becomes difficult to obtain the effect of the precipitation strengthening. Therefore, this cooling is stopped at a temperature of 500° C. or more.

(Second Cooling)

After the first cooling, the steel sheet is cooled on condition that the average cooling rate to 450° C. is 0.008° C./sec to 1.000° C./sec. A temperature of the steel sheet decreases during the second cooling, and while the temperature reaches 450° C., the generation of the grains having an intragranular misorientation of 5° to 14° is promoted and cementite, the Nb carbide, and the composite carbide of Ti and Cr precipitate and grow. When the average cooling rate to 450° C. is less than 0.008° C./sec, the proportion of the grains having an intragranular misorientation of 5° to 14° decreases and the Nb carbide and the composite carbide of Ti and Cr grow excessively, so that it becomes difficult to obtain the effect of the precipitation strengthening. Therefore, this average cooling rate is 0.008° C./sec or more. When this average cooling rate is more than 1.000° C./sec, the proportion of the grains having an intragranular misorientation of 5° to 14° decreases and a shortage of precipitation of the Nb carbide and the composite carbide of Ti and Cr is caused, so that it becomes difficult to obtain the effect of the precipitation strengthening. Therefore, this average cooling rate is 1.000° C./sec or less. After the second cooling, cooling may be freely performed. That is, as long as it is possible to have specific microstructure and chemical composition, after the second cooling, cooling may be performed to room temperature by water cooling or air cooling, or cooling may be performed to room temperature after performing surface treatment such as galvanization.

The hot-rolled steel sheet according to the present embodiment can be obtained as described above.

It is preferable to perform skin pass rolling of the obtained hot-rolled steel sheet at a reduction ratio of 0.1% to 2.0%. This is because the skin pass rolling allows the ductility to be improved by a correction of a shape of the hot-rolled steel sheet and an introduction of mobile dislocation. Further, it is preferable to perform pickling of the obtained hot-rolled steel sheet. This is because the pickling allows removal of scales attaching to a surface of the hot-rolled steel sheet. After the pickling, the skin pass rolling at a reduction ratio of 10.0% or less may be performed and cold rolling at a reduction ratio to about 40% may be performed. The above skin pass rolling or cold rolling can be performed inline or offline.

In the hot-rolled steel sheet according to the present embodiment, moreover, heat treatment may be performed on a hot dipping line after the hot rolling or after the cooling, moreover additional surface treatment of the hot-rolled steel sheet may be performed. Giving plating on the hot dipping line improves corrosion resistance of the hot-rolled steel sheet.

When the hot-rolled steel sheet after the pickling is given the galvanization, the obtained hot-rolled steel sheet may be immersed in a galvanizing bath, and alloying treatment may be performed. Performing the alloying treatment improves welding resistance to various welding such as spot welding in addition to improvement in the corrosion resistance in the hot-rolled steel sheet.

A thickness of the hot-rolled steel sheet is 12 mm or less, for example. The hot-rolled steel sheet preferably has tensile strength of 500 MPa or more, and more preferably has tensile strength of 780 MPa or more. Regarding the hole expandability, in a hole expansion test method mentioned in the Japan Iron and Steel Federation Standard JFS T 1001-1996, a hole expansion ratio of 150% or more can be preferably obtained for a 500 MPa class steel sheet, and a hole expansion ratio of 80% or more can be preferably obtained for a steel sheet with the tensile strength of 780 MPa or more.

According to the present embodiment, since the proportion of the grains having an intragranular misorientation of 5° to 14°, the Cr content, the volume ratio of cementite, and others are appropriate, excellent peeling resistance and excellent hole expandability can be obtained.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof. For example, even a hot-rolled steel sheet produced by another method is considered to be in a range of the embodiments as long as the hot-rolled steel sheet has grains and a chemical composition that satisfy the above conditions.

EXAMPLE

Next, examples of the present invention will be described. Conditions in examples are condition examples employed for confirming the applicability and effects of the present invention and the present invention is not limited to these examples. The present invention can employ various conditions as long as the object of the present invention is achieved without departing from the spirit of the present invention.

First Experiment

In a first experiment, first, steel ingots with a mass of 300 kg which have chemical compositions presented in Table 1 were melted in a high-frequency vacuum melting furnace, to obtain steel billets with a thickness of 70 mm by a rolling mill for test. The balances of the steel ingots are Fe and impurities. Then, these steel billets were heated to a predetermined temperature and hot-rolled by a small-sized tandem mill for test to obtain steel sheets with a thickness of 2.0 mm to 3.6 mm. After a completion of the hot rolling, the steel sheets were cooled to a predetermined temperature imitating a coiling temperature, charged in a furnace set to this temperature, and cooled to 450° C. at a predetermined cooling rate. Thereafter, furnace cooling was performed to obtain hot-rolled steel sheets. Table 2 presents these conditions. Further, regarding some of the hot-rolled steel sheets, thereafter, pickling was performed, plating bath immersion was performed, and further alloying treatment was performed. Table 2 also presents presence/absence of the plating bath immersion and presence/absence of the allying treatment. In the plating bath immersion, immersion in a Zn bath of 430° C. to 460° C. was performed and a temperature for the alloying treatment was set to 500° C. to 600° C. Blank columns in Table 1 each indicate that a content of the element is below a detection limit, and the balances are Fe and impurities. Underlines in Table 1 or in Table 2 indicate that numeric values thereof deviate from a range of the present invention or a preferable range. Table 2 indicates that "rolling temperature before the last one pass" is a rolling completion temperature in a stage one before the last stage, "interpass time" is a time period from a rolling completion in the stage one before the last stage to a rolling start in the last stage, and "finish temperature" is a rolling completion temperature in the last stage.

TABLE 1

| STEEL | CHEMICAL COMPOSITION (MASS %) | | | | | | | | | | | | | | | | | [Si]/ | [Mn]/ | Ar3 | |
|---|---|---|---|---|---|---|---|---|---|---|---|---|---|---|---|---|---|---|---|---|---|
| TYPE | C | Si | Mn | P | S | Al | N | Cr | Nb | Ti | Cu | Ni | V | Ca | Mo | REM | B | [Cr] | [Cr] | (° C.) | REMARKS |
| A | 0.045 | 0.05 | 1.48 | 0.008 | 0.003 | 0.05 | 0.0028 | 0.22 | 0.015 | 0.102 | | | | | | | | 0.227 | 6.7 | 815 | INVENTION EXAMPLE |
| B | 0.062 | 0.04 | 1.56 | 0.010 | 0.003 | 0.04 | 0.0027 | 0.38 | 0.014 | 0.098 | | | | | | | | 0.105 | 4.1 | 795 | INVENTION EXAMPLE |
| C | 0.046 | 0.01 | 0.61 | 0.015 | 0.004 | 0.29 | 0.0033 | 0.37 | 0.004 | 0.051 | | | | | | | | 0.027 | 1.6 | 898 | INVENTION EXAMPLE |
| D | 0.083 | 0.05 | 1.35 | 0.012 | 0.005 | 0.03 | 0.0035 | 0.42 | 0.012 | 0.143 | | | | | | | | 0.119 | 3.2 | 806 | INVENTION EXAMPLE |
| E | 0.028 | 0.05 | 1.68 | 0.009 | 0.003 | 0.05 | 0.0031 | 0.26 | 0.018 | 0.087 | | | | | | | | 0.192 | 6.5 | 801 | INVENTION EXAMPLE |
| F | 0.052 | 0.26 | 1.58 | 0.015 | 0.004 | 0.03 | 0.0028 | 0.25 | 0.012 | 0.121 | | | | | | | | 1.040 | 6.3 | 810 | INVENTION EXAMPLE |
| G | 0.065 | 0.08 | 1.32 | 0.012 | 0.005 | 0.04 | 0.0044 | 0.41 | 0.007 | 0.182 | | | | | | | | 0.195 | 3.2 | 816 | INVENTION EXAMPLE |
| H | 0.045 | 0.22 | 2.05 | 0.015 | 0.004 | 0.03 | 0.0025 | 0.24 | 0.018 | 0.046 | | | | | | | | 0.917 | 8.5 | 769 | INVENTION EXAMPLE |
| I | 0.065 | 0.03 | 0.91 | 0.012 | 0.003 | 0.05 | 0.0041 | 0.41 | 0.045 | 0.125 | | | | | | | | 0.073 | 2.2 | 853 | INVENTION EXAMPLE |
| J | 0.042 | 0.05 | 1.77 | 0.013 | 0.004 | 0.03 | 0.0033 | 0.23 | 0.004 | 0.118 | | | | | | | | 0.217 | 7.7 | 790 | INVENTION EXAMPLE |
| K | 0.078 | 0.02 | 0.68 | 0.011 | 0.005 | 0.22 | 0.0042 | 0.87 | 0.005 | 0.124 | | | | | | | | 0.023 | 0.8 | 855 | INVENTION EXAMPLE |
| L | 0.065 | 0.22 | 1.63 | 0.015 | 0.003 | 0.05 | 0.0038 | 0.15 | 0.025 | 0.117 | | | | | | | | 1.467 | 10.9 | 806 | INVENTION EXAMPLE |
| M | 0.042 | 0.22 | 1.45 | 0.012 | 0.004 | 0.03 | 0.0031 | 0.42 | 0.013 | 0.087 | | | 0.12 | | | | | 0.524 | 3.5 | 816 | INVENTION EXAMPLE |
| N | 0.052 | 0.23 | 1.55 | 0.008 | 0.003 | 0.05 | 0.0033 | 0.43 | 0.015 | 0.061 | | | | 0.0009 | | | | 0.535 | 3.6 | 803 | INVENTION EXAMPLE |
| O | 0.048 | 0.05 | 1.51 | 0.013 | 0.002 | 0.03 | 0.0026 | 0.42 | 0.012 | 0.109 | 0.4 | 0.2 | | | | | | 0.119 | 3.6 | 757 | INVENTION EXAMPLE |
| P | 0.050 | 0.04 | 1.51 | 0.012 | 0.003 | 0.03 | 0.0030 | 0.42 | 0.015 | 0.121 | | | 0.03 | 0.0011 | | | | 0.095 | 3.6 | 801 | INVENTION EXAMPLE |
| Q | 0.052 | 0.05 | 1.49 | 0.014 | 0.003 | 0.03 | 0.0027 | 0.39 | 0.009 | 0.112 | | | | | 0.06 | 0.0008 | | 0.128 | 3.8 | 799 | INVENTION EXAMPLE |
| R | 0.042 | 0.05 | 1.42 | 0.015 | 0.002 | 0.04 | 0.0029 | 0.29 | 0.014 | 0.103 | | | | | | | 0.0006 | 0.172 | 4.9 | 820 | INVENTION EXAMPLE |
| S | 0.045 | 0.09 | 1.38 | 0.013 | 0.002 | 0.03 | 0.0036 | 0.01 | 0.040 | 0.131 | | | | | | | | 9.000 | 138.0 | 836 | COMPARATIVE EXAMPLE |
| T | 0.052 | 0.95 | 0.57 | 0.014 | 0.004 | 0.03 | 0.0034 | 0.21 | 0.025 | 0.125 | | | | | | | | 4.524 | 2.7 | 885 | COMPARATIVE EXAMPLE |
| U | 0.060 | 0.11 | 2.68 | 0.010 | 0.002 | 0.03 | 0.0030 | 0.06 | 0.032 | 0.105 | | | | | | | | 1.833 | 44.7 | 709 | COMPARATIVE EXAMPLE |
| V | 0.160 | 0.05 | 2.41 | 0.012 | 0.003 | 0.05 | 0.0035 | 0.21 | 0.004 | 0.067 | | | | | | | | 0.238 | 11.5 | 694 | COMPARATIVE EXAMPLE |
| W | 0.045 | 0.04 | 0.98 | 0.015 | 0.005 | 0.03 | 0.0032 | 0.44 | 0.152 | 0.081 | | | | | | | | 0.091 | 2.2 | 852 | COMPARATIVE EXAMPLE |

TABLE 1-continued

| STEEL | CHEMICAL COMPOSITION (MASS %) | | | | | | | | | | | | | | | | | [Si]/ | [Mn]/ | Ar3 | |
|---|---|---|---|---|---|---|---|---|---|---|---|---|---|---|---|---|---|---|---|---|---|
| TYPE | C | Si | Mn | P | S | Al | N | Cr | Nb | Ti | Cu | Ni | V | Ca | Mo | REM | B | [Cr] | [Cr] | (° C.) | REMARKS |
| X | 0.035 | 0.12 | 1.32 | 0.018 | 0.004 | 0.03 | 0.0036 | 0.41 | 0.016 | 0.267 | | | | | | | | 0.293 | 3.2 | 829 | COMPARATIVE EXAMPLE |
| Y | 0.051 | 0.08 | 1.68 | 0.016 | 0.005 | 0.03 | 0.0033 | 0.25 | 0.015 | 0.001 | | | | | | | | 0.320 | 6.7 | 796 | COMPARATIVE EXAMPLE |
| Z | 0.048 | 0.06 | 0.42 | 0.012 | 0.003 | 0.05 | 0.0038 | 0.94 | 0.016 | 0.088 | | | | | | | | 0.064 | 0.4 | 880 | COMPARATIVE EXAMPLE |

TABLE 2

| | | | | | ROUGH ROLLGIN | | FINISH ROLLING | | | | | |
|---|---|---|---|---|---|---|---|---|---|---|---|---|
| | | | | | | | ROLLING | | | | | CUMULATIVE |
| TEST NUMBER | STEEL TYPE | $SRT_{min}$ (° C.) | HEATING TEMPERATURE (° C.) | Ar3 (° C.) | FINISH TEMPERATURE (° C.) | CUMULATIVE REDUCTION RATIO (%) | TEMPERATURE BEFORE LAST ONE PASS (° C.) | INTERPASS TIME (s) | LEFT PART OF EXPRESSION 3 | RIGHT PART OF EXPRESSION 3 | FINISH TEMPERATURE (° C.) | STRAIN IN LAST THREE STAGES |
| 1 | A | 1103 | 1180 | 815 | 1080 | 65 | 935 | 0.64 | 0.20 | 1.22 | 920 | 0.572 |
| 2 | A | 1103 | 1180 | 815 | 1080 | 65 | 935 | 0.64 | 0.20 | 1.22 | 920 | 0.572 |
| 3 | A | 1103 | 1180 | 815 | 1080 | 65 | 935 | 0.64 | 0.20 | 1.22 | 920 | 0.572 |
| 4 | A | 1103 | 1180 | 815 | 1080 | 65 | 935 | 0.64 | 0.20 | 1.22 | 920 | 0.572 |
| 5 | A | 1103 | 1180 | 815 | 1080 | 65 | 935 | 0.64 | 0.20 | 1.22 | 920 | 0.572 |
| 6 | B | 1136 | 1220 | 795 | 1100 | 71 | 912 | 0.53 | 0.21 | 1.29 | 900 | 0.540 |
| 7 | B | 1136 | 1220 | 795 | 1100 | 45 | 945 | 0.53 | 0.18 | 1.12 | 930 | 0.583 |
| 8 | B | 1136 | 1220 | 795 | 1100 | 81 | 876 | 0.53 | 0.24 | 1.51 | 860 | 0.527 |
| 9 | B | 1136 | 1220 | 795 | 1100 | 45 | 945 | 0.53 | 0.18 | 1.12 | 930 | 0.583 |
| 10 | C | 1028 | 1180 | 898 | 1080 | 71 | 950 | 0.59 | 0.08 | 0.55 | 940 | 0.535 |
| 11 | D | 1224 | 1250 | 806 | 1120 | 71 | 935 | 0.64 | 0.25 | 1.84 | 920 | 0.583 |
| 12 | E | 1032 | 1180 | 801 | 1080 | 65 | 893 | 0.60 | 0.22 | 1.30 | 880 | 0.588 |
| 13 | F | 1141 | 1180 | 810 | 1080 | 65 | 893 | 0.60 | 0.26 | 1.68 | 880 | 0.588 |
| 14 | G | 1224 | 1250 | 816 | 1120 | 71 | 935 | 0.64 | 0.30 | 2.01 | 920 | 0.514 |
| 15 | H | 1015 | 1180 | 769 | 1080 | 65 | 870 | 0.58 | 0.16 | 0.86 | 880 | 0.565 |
| 16 | I | 1173 | 1220 | 853 | 1100 | 71 | 893 | 0.36 | 0.38 | 2.06 | 880 | 0.588 |
| 17 | J | 1112 | 1180 | 790 | 1080 | 65 | 893 | 0.60 | 0.23 | 1.56 | 880 | 0.527 |
| 18 | K | 1196 | 1250 | 855 | 1120 | 71 | 935 | 0.64 | 0.20 | 1.37 | 920 | 0.572 |
| 19 | L | 1165 | 1220 | 806 | 1100 | 71 | 893 | 0.60 | 0.30 | 1.75 | 880 | 0.518 |
| 20 | M | 1076 | 1180 | 816 | 1080 | 65 | 893 | 0.60 | 0.20 | 1.25 | 880 | 0.572 |
| 21 | N | 1061 | 1180 | 803 | 1080 | 65 | 893 | 0.60 | 0.16 | 0.93 | 880 | 0.572 |
| 22 | O | 1118 | 1200 | 757 | 1100 | 71 | 912 | 0.53 | 0.22 | 1.40 | 900 | 0.540 |
| 23 | P | 1136 | 1180 | 801 | 1080 | 65 | 935 | 0.64 | 0.23 | 1.42 | 920 | 0.572 |
| 24 | Q | 1131 | 1200 | 799 | 1100 | 71 | 914 | 0.53 | 0.21 | 1.40 | 900 | 0.540 |
| 25 | R | 1095 | 1200 | 820 | 1100 | 45 | 955 | 0.40 | 0.18 | 1.13 | 940 | 0.583 |
| 26 | A | 1103 | 1180 | 815 | 1080 | 65 | 935 | 0.64 | 0.20 | 1.22 | 920 | 0.572 |
| 27 | A | 1103 | 1180 | 815 | 1080 | 65 | 935 | 0.64 | 0.20 | 1.22 | 920 | 0.572 |
| 28 | A | 1103 | 1180 | 815 | 1080 | 65 | 935 | 0.64 | 0.20 | 1.22 | 700 | 0.583 |
| 29 | A | 1103 | 1180 | 815 | 1080 | 65 | 821 | 0.64 | 0.33 | 2.06 | 820 | 0.693 |
| 30 | A | 1103 | 1180 | 815 | 1080 | 65 | 955 | 0.64 | 0.18 | 1.12 | 940 | 0.421 |
| 31 | A | 1103 | 1120 | 815 | 950 | 45 | 821 | 0.64 | 0.33 | 2.06 | 820 | 0.549 |
| 32 | B | 1135 | 1220 | 795 | 1100 | 71 | 912 | 0.53 | 0.21 | 1.29 | 900 | 0.549 |
| 33 | B | 1136 | 1200 | 795 | 1100 | 71 | 912 | 0.53 | 0.21 | 1.29 | 900 | 0.549 |
| 34 | B | 1136 | 1200 | 795 | 1100 | 71 | 912 | 0.53 | 0.21 | 1.29 | 900 | 0.549 |
| 35 | B | 1136 | 1100 | 795 | 1060 | 45 | 872 | 0.64 | 0.25 | 1.54 | 860 | 0.549 |
| 36 | S | 1133 | 1250 | 836 | 1080 | 65 | 935 | 0.64 | 0.31 | 1.74 | 920 | 0.572 |
| 37 | T | 1148 | 1250 | 885 | 1080 | 65 | 935 | 0.64 | 0.33 | 1.91 | 920 | 0.572 |
| 38 | U | 1141 | 1180 | 709 | 1080 | 65 | 621 | 0.39 | 0.42 | 2.35 | 820 | 0.580 |
| 39 | V | 1210 | 1250 | 694 | 1120 | 71 | 821 | 0.39 | 0.19 | 1.27 | 820 | 0.580 |
| 40 | W | 1076 | 1180 | 852 | 1080 | 65 | 893 | 0.68 | 0.65 | 2.65 | 880 | 0.576 |
| 41 | X | 1192 | 1250 | 829 | 1120 | 71 | 935 | 0.84 | 0.45 | 3.00 | 920 | 0.572 |
| 42 | Y | 721 | 1180 | 796 | 1080 | 65 | 893 | 0.60 | 0.05 | 0.16 | 880 | 0.576 |
| 43 | Z | 1093 | 1180 | 880 | 1080 | 85 | 935 | 0.64 | 0.18 | 1.08 | 920 | 0.572 |

TABLE 2-continued

| TEST NUMBER | FIRST COOLING COOLING RATE (° C./s) | FIRST COOLING STOP TEMPERATURE (° C.) | SECOND COOLING START TEMPERATURE (° C.) | SECOND COOLING COOLING RATE TO 450° C. (° C./s) | PLATING BATH IMMERSION | ALLOYING TREATMENT | REMARKS |
|---|---|---|---|---|---|---|---|
| 1 | 40 | 570 | 570 | 0.013 | ABSENCE | ABSENCE | INVENTION EXAMPLE |
| 2 | 30 | 630 | 630 | 0.013 | ABSENCE | ABSENCE | INVENTION EXAMPLE |
| 3 | 30 | 600 | 600 | 0.014 | PRESSNCE | ABSENCE | INVENTION EXAMPLE |
| 4 | 40 | 570 | 570 | 0.013 | PRESENCE | PRESENCE | INVENTION EXAMPLE |
| 5 | 40 | 570 | 570 | 0.722 | ABSENCE | ABSENCE | INVENTION EXAMPLE |
| 6 | 40 | 570 | 570 | 0.013 | ABSENCE | ABSENCE | INVENTION EXAMPLE |
| 7 | 40 | 570 | 570 | 0.013 | ABSENCE | ABSENCE | INVENTION EXAMPLE |
| 8 | 40 | 570 | 570 | 0.013 | ABSENCE | A8SENCE | INVENTION EXAMPLE |
| 9 | 40 | 570 | 570 | 0.722 | ABSENCE | ABSENCE | INVENTION EXAMPLE |
| 10 | 40 | 570 | 570 | 0.013 | ABSENCE | ABSENCE | INVENTION EXAMPLE |
| 11 | 40 | 540 | 540 | 0.167 | ABSENCE | ABSENCE | INVENTION EXAMPLE |
| 12 | 20 | 540 | 540 | 0.013 | ABSENCE | ABSENCE | INVENTION EXAMPLE |
| 13 | 20 | 630 | 630 | 0.015 | ABSENCE | ABSENCE | INVENTION EXAMPLE |
| 14 | 20 | 630 | 630 | 0.009 | ABSENCE | ABSENCE | INVENTION EXAMPLE |
| 15 | 40 | 570 | 570 | 0.013 | ABSENCE | ABSENCE | INVENTION EXAMPLE |
| 16 | 20 | 600 | 600 | 0.014 | ABSENCE | ABSENCE | INVENTION EXAMPLE |
| 17 | 40 | 570 | 570 | 0.013 | ABSENCE | ABSENCE | INVENTION EXAMPLE |
| 18 | 30 | 630 | 630 | 0.015 | PRESENCE | ABSENCE | INVENTION EXAMPLE |
| 19 | 30 | 630 | 630 | 0.015 | PRESENCE | ABSENCE | INVENTION EXAMPLE |
| 20 | 40 | 570 | 570 | 0.013 | ABSENCE | ABSENCE | INVENTION EXAMPLE |
| 21 | 40 | 570 | 570 | 0.013 | ABSENCE | ABSENCE | INVENTION EXAMPLE |
| 22 | 40 | 570 | 570 | 0.013 | PRESENCE | PRESENCE | INVENTION EXAMPLE |
| 23 | 40 | 570 | 570 | 0.013 | ABSENCE | ABSENCE | INVENTION EXAMPLE |

TABLE 2-continued

| | | | | | | | |
|---|---|---|---|---|---|---|---|
| 24 | 30 | 630 | 630 | 0.015 | ABSENCE | ABSENCE | INVENTION EXAMPLE |
| 25 | 40 | 570 | 570 | 0.556 | ABSENCE | ABSENCE | INVENTION EXAMPLE |
| 26 | 2 | 630 | 630 | 0.009 | ABSENCE | ABSENCE | COMPARATIVE EXAMPLE |
| 27 | 30 | 720 | 720 | 0.009 | ABSENCE | ABSENCE | COMPARATIVE EXAMPLE |
| 28 | 20 | 630 | 630 | 0.015 | ABSENCE | ABSENCE | COMPARATIVE EXAMPLE |
| 29 | 20 | 630 | 630 | 0.015 | ABSENCE | ABSENCE | COMPARATIVE EXAMPLE |
| 30 | 40 | 540 | 540 | 0.556 | ABSENCE | ABSENCE | COMPARATIVE EXAMPLE |
| 31 | 30 | 630 | 630 | 0.015 | ABSENCE | ABSENCE | COMPARATIVE EXAMPLE |
| 32 | 40 | 460 | 460 | 0.010 | ABSENCE | ABSENCE | COMPARATIVE EXAMPLE |
| 33 | 40 | 570 | 570 | 0.001 | ABSENCE | ABSENCE | COMPARATIVE EXAMPLE |
| 34 | 20 | 630 | 630 | 30.000 | ABSENCE | ABSENCE | COMPARATIVE EXAMPLE |
| 35 | 30 | 630 | 630 | 0.015 | ABSENCE | ABSENCE | COMPARATIVE EXAMPLE |
| 36 | 30 | 630 | 630 | 0.015 | ABSENCE | ABSENCE | COMPARATIVE EXAMPLE |
| 37 | 30 | 630 | 630 | 0.015 | ABSENCE | ABSENCE | COMPARATIVE EXAMPLE |
| 38 | 40 | 540 | 540 | 0.013 | ABSENCE | ABSENCE | COMPARATIVE EXAMPLE |
| 39 | 40 | 630 | 630 | 0.013 | ABSENCE | ABSENCE | COMPARATIVE EXAMPLE |
| 40 | 40 | 570 | 570 | 0.013 | ABSENCE | ABSENCE | COMPARATIVE EXAMPLE |
| 41 | 30 | 630 | 630 | 0.015 | ABSENCE | ABSENCE | COMPARATIVE EXAMPLE |
| 42 | 30 | 630 | 630 | 0.015 | ABSENCE | ABSENCE | COMPARATIVE EXAMPLE |
| 43 | 30 | 630 | 630 | 0.015 | ABSENCE | ABSENCE | COMPARATIVE EXAMPLE |

Thereafter, regarding each of the hot-rolled steel sheets, measurement of a proportion of grains having an intragranular misorientation of 5° to 14°, observation of a microstructure, measurement of a mechanical property, and confirmation of presence/absence of fracture surface cracking were performed by an EBSD analysis. Table 3 presents these results. Underlines in Table 3 indicate that numeric values thereof deviate from a range of the present invention or a preferable range.

In the observation of the microstructure, an area ratio (Zw) of a continuous cooling transformation structure (Zw) and an area ratio of polygonal ferrite (PF) in a ¼ sheet thickness of the hot-rolled steel sheets were measured. In the observation of the microstructure, measurements of an area ratio and an average grain diameter of cementite, a proportion r of cementite having a grain diameter of 0.5 μm or less and an aspect ratio of 5 or less in all cementite, and a concentration of Cr contained in cementite were also performed. In the observation of the microstructure, measurements of an average grain diameter of a composite carbide of Ti and Cr, a concentration of Cr in the composite carbide of Ti and Cr, and a number density of the composite carbide of Ti and Cr were also performed. These measuring methods are as described above.

In the measurement of the mechanical property, a tensile test using a sheet thickness direction (C direction) JIS 5 test piece and a hole expansion test mentioned in JFS T 1001-1996 were performed to find tensile strength (TS), elongation (EL), and a hole expansion ratio (λ). The confirmation of the presence/absence of the fracture surface cracking was performed by visual observation.

TABLE 3

| TEST NUMBER | STEEL TYPE | PROPORTION OF GRAINS HAVING INTRA-GRANULAR MISORIAN-TATION OF 5° TO 14° (%) | MICRO STRUCTURE: AREA RATIO OF Zw (%) | AREA RATIO OF PF (%) | CEMENTITE: AREA RATIO (%) | AVERAGE GRAIN DIAMETER (μm) | PRO-PORTION r (%) | Cr CONCEN-TRATION (MASS %) | COMPOSITE CARBIDE: AVERAGE GRAIN DIAMETER (nm) | SOLID SOLUTION AMOUNT OF Cr (MASS %) | NUMBER DENSITY ($\times 10^{13}$/mm$^3$) | MECHANICAL PROPERTY: TS (MPa) | EL (%) | λ (%) | FRACTURE SURFACE CRACKING | REMARKS |
|---|---|---|---|---|---|---|---|---|---|---|---|---|---|---|---|---|
| 1 | A | 56.3 | 95.7 | 4.2 | 0.1 | 0.18 | 94 | 8.4 | 5.7 | 4.2 | 4.2 | 795 | 20 | 108 | ABSENCE | INVENTION EXAMPLE |
| 2 | A | 53.8 | 91.5 | 8.4 | 0.1 | 0.25 | 86 | 7.4 | 6.3 | 5.8 | 3.6 | 783 | 21 | 91 | ABSENCE | INVENTION EXAMPLE |
| 3 | A | 55.0 | 93.5 | 6.4 | 0.1 | 0.22 | 91 | 7.9 | 6.1 | 4.3 | 3.9 | 792 | 19 | 95 | ABSENCE | INVENTION EXAMPLE |
| 4 | A | 55.6 | 94.6 | 5.3 | 0.1 | 0.21 | 92 | 8.1 | 5.6 | 4.1 | 4.6 | 802 | 19 | 96 | ABSENCE | INVENTION EXAMPLE |
| 5 | A | 56.1 | 95.3 | 4.8 | 0.1 | 0.16 | 95 | 7.6 | 4.8 | 4.6 | 5.2 | 807 | 20 | 103 | ABSENCE | INVENTION EXAMPLE |
| 6 | B | 56.8 | 96.5 | 3.2 | 0.3 | 0.28 | 81 | 9.8 | 6.8 | 8.1 | 6.9 | 788 | 19 | 83 | ABSENCE | INVENTION EXAMPLE |
| 7 | B | 51.1 | 86.8 | 12.9 | 0.3 | 0.32 | 86 | 10.2 | 7.1 | 8.5 | 6.3 | 785 | 20 | 88 | ABSENCE | INVENTION EXAMPLE |
| 8 | B | 54.3 | 92.3 | 7.4 | 0.3 | 0.31 | 82 | 11.5 | 6.6 | 9.2 | 6.8 | 791 | 20 | 82 | ABSENCE | INVENTION EXAMPLE |
| 9 | B | 56.2 | 95.6 | 4.2 | 0.2 | 0.19 | 93 | 9.6 | 5.2 | 7.8 | 7.1 | 806 | 19 | 86 | ABSENCE | INVENTION EXAMPLE |
| 10 | C | 28.6 | 88.6 | 11.2 | 0.2 | 0.25 | 95 | 10.5 | 6.1 | 7.8 | 6.8 | 524 | 27 | 172 | ABSENCE | INVENTION EXAMPLE |
| 11 | D | 63.2 | 92.7 | 6.9 | 0.4 | 0.36 | 92 | 12.3 | 5.3 | 10.8 | 7.3 | 825 | 19 | 92 | ABSENCE | INVENTION EXAMPLE |
| 12 | E | 59.6 | 90.3 | 9.6 | 0.1 | 0.29 | 93 | 9.1 | 5.9 | 6.1 | 3.8 | 786 | 21 | 89 | ABSENCE | INVENTION EXAMPLE |
| 13 | F | 39.8 | 83.1 | 16.8 | 0.1 | 0.22 | 89 | 5.6 | 6.6 | 5.1 | 4.1 | 793 | 20 | 91 | ABSENCE | INVENTION EXAMPLE |
| 14 | G | 73.5 | 94.6 | 5.2 | 0.2 | 0.29 | 88 | 6.8 | 9.6 | 12.1 | 9.1 | 842 | 18 | 85 | ABSENCE | INVENTION EXAMPLE |
| 15 | H | 65.1 | 91.7 | 8.2 | 0.1 | 0.22 | 91 | 6.5 | 5.5 | 4.3 | 1.2 | 796 | 20 | 96 | ABSENCE | INVENTION EXAMPLE |
| 16 | I | 62.5 | 93.2 | 6.5 | 0.3 | 0.28 | 85 | 10.3 | 6.8 | 10.1 | 6.5 | 792 | 19 | 88 | ABSENCE | INVENTION EXAMPLE |
| 17 | J | 52.4 | 86.6 | 13.2 | 0.2 | 0.23 | 83 | 6.6 | 6.4 | 5.6 | 4.1 | 753 | 22 | 105 | ABSENCE | INVENTION EXAMPLE |
| 18 | K | 58.9 | 87.8 | 12.1 | 0.1 | 0.17 | 95 | 35.6 | 6.1 | 15.2 | 8.8 | 812 | 20 | 94 | ABSENCE | INVENTION EXAMPLE |
| 19 | L | 42.3 | 86.3 | 13.2 | 0.5 | 0.31 | 62 | 2.3 | 7.1 | 3.2 | 2.5 | 763 | 20 | 91 | ABSENCE | INVENTION EXAMPLE |

TABLE 3-continued

| TEST NUMBER | STEEL TYPE | PROPORTION OF GRAINS HAVING INTRA-GRANULAR MISORIAN-TATION OF 5° TO 14° (%) | MICRO STRUCTURE: AREA RATIO OF Zw (%) | AREA RATIO OF PF (%) | CEMENTITE: AREA RATIO (%) | CEMENTITE: AVERAGE GRAIN DIAMETER (μm) | CEMENTITE: PRO-PORTION r (%) | CEMENTITE: Cr CONCEN-TRATION (MASS %) | COMPOSITE CARBIDE: AVERAGE GRAIN DIAMETER (nm) | COMPOSITE CARBIDE: SOLID SOLUTION AMOUNT OF Cr (MASS %) | COMPOSITE CARBIDE: NUMBER DENSITY ($\times 10^{13}$/mm$^3$) | MECHANICAL PROPERTY: TS (MPa) | MECHANICAL PROPERTY: EL (%) | MECHANICAL PROPERTY: λ (%) | FRACTURE SURFACE CRACKING | REMARKS |
|---|---|---|---|---|---|---|---|---|---|---|---|---|---|---|---|---|
| 20 | M | 56.8 | 94.6 | 5.3 | 0.1 | 0.22 | 89 | 8.2 | 6.1 | 7.6 | 7.1 | 772 | 21 | 93 | ABSENCE | INVENTION EXAMPLE |
| 21 | N | 54.7 | 93.2 | 6.7 | 0.1 | 0.21 | 92 | 8.9 | 6.6 | 6.8 | 6.9 | 783 | 20 | 101 | ABSENCE | INVENTION EXAMPLE |
| 22 | O | 55.9 | 93.6 | 6.3 | 0.1 | 0.22 | 93 | 9.6 | 5.6 | 8.2 | 7.6 | 812 | 19 | 112 | ABSENCE | INVENTION EXAMPLE |
| 23 | P | 59.1 | 93.8 | 6.1 | 0.1 | 0.22 | 91 | 11.9 | 5.3 | 7.9 | 7.2 | 788 | 20 | 105 | ABSENCE | INVENTION EXAMPLE |
| 24 | Q | 52.3 | 96.1 | 3.7 | 0.2 | 0.25 | 86 | 10.8 | 6.1 | 7.3 | 6.8 | 809 | 19 | 96 | ABSENCE | INVENTION EXAMPLE |
| 25 | R | 75.3 | 98.3 | 1.6 | 0.1 | 0.19 | 93 | 10.1 | 6.5 | 5.6 | 5.6 | 821 | 20 | 93 | ABSENCE | INVENTION EXAMPLE |
| 26 | A | 18.6 | 57.6 | 42.3 | 0.1 | 3.20 | 25 | 0.3 | 12.8 | 1.6 | 0.8 | 745 | 22 | 63 | ABSENCE | COMPARATIVE EXAMPLE |
| 27 | A | 17.2 | 43.2 | 56.7 | 0.1 | 3.60 | 19 | 0.1 | 13.4 | 0.4 | 0.9 | 753 | 23 | 51 | PRESENCE | COMPARATIVE EXAMPLE |
| 28 | A | 13.1 | 21.6 | 77.3 | 1.1 | 3.40 | 15 | 0.1 | 13.1 | 0.3 | 0.6 | 709 | 19 | 55 | PRESENCE | COMPARATIVE EXAMPLE |
| 29 | A | 13.8 | 31.0 | 68.2 | 0.8 | 2.70 | 18 | 0.3 | 11.3 | 0.4 | 0.8 | 712 | 19 | 58 | PRESENCE | COMPARATIVE EXAMPLE |
| 30 | A | 18.5 | 43.2 | 4.4 | 0.1 | 2.10 | 31 | 0.1 | 5.6 | 0.2 | 0.4 | 867 | 13 | 45 | PRESENCE | COMPARATIVE EXAMPLE |
| 31 | A | 16.2 | 37.6 | 61.2 | 1.2 | 2.30 | 28 | 0.3 | 12.1 | 0.4 | 0.8 | 771 | 17 | 58 | PRESENCE | COMPARATIVE EXAMPLE |
| 32 | B | 19.2 | 93.6 | 6.2 | 0.2 | 0.22 | 84 | 7.6 | 6.8 | 1.8 | 0.6 | 723 | 21 | 78 | ABSENCE | COMPARATIVE EXAMPLE |
| 33 | B | 18.7 | 90.4 | 9.4 | 0.2 | 1.20 | 43 | 6.5 | 12.1 | 4.3 | 0.8 | 756 | 20 | 62 | PRESENCE | COMPARATIVE EXAMPLE |
| 34 | B | 16.5 | 32.6 | 5.2 | 0.1 | 2.30 | 24 | 0.1 | 6.1 | 0.3 | 0.5 | 897 | 15 | 57 | PRESENCE | COMPARATIVE EXAMPLE |
| 35 | B | 19.4 | 91.6 | 8.2 | 0.2 | 0.33 | 72 | 6.2 | 6.1 | 0.6 | 0.5 | 725 | 20 | 71 | PRESENCE | COMPARATIVE EXAMPLE |
| 36 | S | 18.4 | 75.6 | 24.2 | 0.2 | 2.30 | 43 | 0.1 | 11.6 | 0.0 | 0.7 | 748 | 20 | 58 | PRESENCE | COMPARATIVE EXAMPLE |
| 37 | T | 9.7 | 25.9 | 73.9 | 0.2 | 0.87 | 57 | 0.3 | 10.9 | 0.8 | 0.8 | 713 | 24 | 56 | PRESENCE | COMPARATIVE EXAMPLE |
| 38 | U | 13.6 | 96.1 | 3.6 | 0.3 | 2.90 | 29 | 0.2 | 12.5 | 0.6 | 0.9 | 755 | 19 | 41 | PRESENCE | COMPARATIVE EXAMPLE |
| 39 | V | 9.3 | 93.6 | 3.2 | 3.2 | 3.60 | 18 | 0.4 | 13.2 | 0.8 | 0.6 | 761 | 19 | 45 | PRESENOE | COMPARATIVE EXAMPLE |

TABLE 3-continued

| TEST NUMBER | STEEL TYPE | PROPORTION OF GRAINS HAVING INTRA-GRANULAR MISORIAN-TATION OF 5° TO 14° (%) | MICRO STRUCTURE: AREA RATIO OF Zw (%) | AREA RATIO OF PF (%) | CEMENTITE: AREA RATIO (%) | AVERAGE GRAIN DIAMETER (μm) | PRO-PORTION r (%) | Cr CONCEN-TRATION (MASS %) | COMPOSITE CARBIDE: AVERAGE GRAIN DIAMETER (nm) | SOLID SOLUTION AMOUNT OF Cr (MASS %) | NUMBER DENSITY ($\times 10^{13}/mm^3$) | MECHANICAL PROPERTY: TS (MPa) | EL (%) | λ (%) | FRACTURE SURFACE CRACKING | REMARKS |
|---|---|---|---|---|---|---|---|---|---|---|---|---|---|---|---|---|
| 40 | W | 6.5 | 41.9 | 2.9 | 0.3 | 2.30 | 26 | 0.1 | 6.8 | 2.6 | 0.8 | 884 | 13 | 48 | PRESENCE | COMPARATIVE EXAMPLE |
| 41 | X | 12.7 | 96.3 | 3.6 | 0.1 | 0.32 | 66 | 4.3 | 15.8 | 5.1 | 4.2 | 876 | 15 | 41 | PRESENCE | COMPARATIVE EXAMPLE |
| 42 | Y | 16.9 | 43.5 | 56.1 | 0.4 | 0.38 | 72 | 5.9 | — | — | — | 702 | 19 | 72 | PRESENCE | COMPARATIVE EXAMPLE |
| 43 | Z | 13.3 | 39.7 | 3.2 | 0.2 | 0.17 | 87 | 41.8 | 6.7 | 0.7 | 0.9 | 734 | 20 | 59 | PRESENCE | COMPARATIVE EXAMPLE |

As presented in Table 3, since test numbers 1 to 25 were in the range of the present invention, high tensile strength could be obtained, an excellent strength-ductility balance (TS×EL) and an excellent strength-hole expansion balance (TS×λ) could be obtained, and excellent peeling resistance could be obtained.

On the other hand, since test numbers 26 to 43 deviated from the range of the present invention, any of tensile strength, a strength-ductility balance, a strength-hole expansion balance, and peeling resistance was inferior.

INDUSTRIAL APPLICABILITY

The present invention may be used for a manufacturing industry and a utilization industry of a hot-rolled steel sheet used for various steel manufactures such as an inner sheet member, a structural member, and an underbody member of an automobile, for example.

The invention claimed is:

1. A hot-rolled steel sheet comprising a chemical composition represented by, in mass %, C: 0.010% to 0.100%, Si: 0.30% or less, Mn: 0.40% to 3,00%, P: 0.100% or less, S: 0.030% or less, Al: 0,010% to 0.500%, N: 0.0100% or less, Cr: 0.05% to 1.00%, Nb: 0.003% to 0.050%, Ti: 0.003% to 0.200%, Cu: 0.0% to 1.2%, Ni: 0.0% to 0.6%, Mo: 0.00% to 1.00%, V: 0.00% to 0.20%, Ca: 0.0000% to 0.0050%, REM: 0.0000% to 0.0200%, B: 0.0000% to 0.0020%, and a balance: Fe and impurities, wherein relationships represented by Expression 1 and Expression 2 are satisfied, Expression 1: $0.005\ 5 \leq [Si]/[Cr] \leq 2.000$ Expression 2: $0.5 \leq [Mn]/[Cr] \leq 20.0$ wherein [Si], [Cr], and [Mn] in the Expression 1 and Expression 2 each represent a content, in mass %, of each of the elements, respectively, and wherein a proportion of grains having an intragranular misorientation of 5° to 14° in all grains is 20% or more by area ratio, wherein each grain is defined as an area which is surrounded by a boundary having a misorientation of 15° or more, and wherein each grain has a circle-equivalent diameter of 0.3 μm or more, the hot-rolled steel sheet comprising a microstructure represented by a volume ratio of cementite: 1.0% or less, an average grain diameter of cementite; 2.00 μm or less, a concentration of Cr contained in cementite; 0.5 mass % to 40.0 mass %, a proportion of cementite having a grain diameter of 0.5 μm or less and an aspect ratio of 5 or less in all cementite: 60 vol % or more, an average grain diameter of a composite carbide of Ti and Cr: 10.0 nm or less, and a number density of the composite carbide of Ti and Cr: $1.0 \times 10^{13}/mm^3$ or more.

2. The hot-rolled steel sheet according to claim 1, wherein, in the chemical composition represented by, in mass %, Cu: 0.2% to 1.2%, Ni: 0.1% to 0.6%, Mo: 0.05% to 1.00%, or V: 0.02% to 0.20%, or any combination thereof is satisfied.

3. The hot-rolled steel sheet according to claim 1, wherein, in the chemical composition represented by, in mass %, Ca: 0.0005% to 0.0050%, or REM: 0.0005% to 0.0200%, or a combination thereof is satisfied.

4. The hot-rolled steel sheet according to claim 1, wherein, in the chemical composition represented by, in mass %, 13: 0.0002% to 0.0020% is satisfied.

5. The hot-rolled steel sheet according to claim 1, comprising a galvanized film on a surface.

* * * * *